US007377622B2

(12) United States Patent
Nakazawa

(10) Patent No.: US 7,377,622 B2
(45) Date of Patent: May 27, 2008

(54) INK JET RECORDING APPARATUS AND INK JET RECORDING METHOD

(75) Inventor: Yusuke Nakazawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 456 days.

(21) Appl. No.: 11/245,197

(22) Filed: Oct. 7, 2005

(65) Prior Publication Data

US 2006/0077232 A1 Apr. 13, 2006

(30) Foreign Application Priority Data

Oct. 7, 2004 (JP) ..... 2004-294957
Oct. 7, 2004 (JP) ..... 2004-294966

(51) Int. Cl.
*B41J 2/06* (2006.01)
*B41J 2/065* (2006.01)

(52) U.S. Cl. ..... 347/55

(58) Field of Classification Search ..... 347/55
See application file for complete search history.

(56) References Cited

U.S. PATENT DOCUMENTS 5,828,393 A * 10/1998 Hotomi ..... 347/71
5,898,446 A 4/1999 Moriyama
6,241,341 B1 * 6/2001 Nakazawa et al. ..... 347/51
6,305,787 B1 * 10/2001 Nakazawa et al. ..... 347/51
6,817,692 B2 11/2004 Nakazawa et al.
6,862,992 B2 * 3/2005 Nakazawa et al. ..... 101/466
7,205,097 B2 * 4/2007 Fukunaga et al. ..... 430/320
7,311,384 B2 * 12/2007 Nakazawa et al. ..... 347/55
2004/0001134 A1 1/2004 Nakazawa et al.
2005/0062808 A1 * 3/2005 Nakazawa ..... 347/84
2005/0200657 A1 * 9/2005 Nakazawa ..... 347/55
2006/0055716 A1 * 3/2006 Nakazawa et al. ..... 347/5

FOREIGN PATENT DOCUMENTS

EP 0803358 A2 10/1997
EP 0911164 A2 4/1999

* cited by examiner

*Primary Examiner*—Huan H Tran
(74) *Attorney, Agent, or Firm*—Sughrue Mion, PLLC

(57) ABSTRACT

The ink jet recording method and apparatus convey a recording medium to a position opposing an ink jet head by a conveyor and record an image onto the recording medium conveyed to the position with the ink jet head by ejecting ink droplets from at least one ejection portion toward the recording medium through exertion of electrostatic force on ink in accordance with an image signal. The method and apparatus pass through the position a strong electric field formation portion giving to the ejection portion an electric field strength stronger than that of the recording medium or give to the ejection portion an electric field strength stronger than that formed in the ejection portion in a non-ink droplet ejection period during the recording of the image on the recording medium, immediately before the recording medium and the ink jet head are relatively moved to the image recordable position.

23 Claims, 14 Drawing Sheets

INK JET RECORDING APPARATUS AND INK JET RECORDING METHOD

BACKGROUND OF THE INVENTION

The present invention relates to a technical field of an electrostatic ink jet recording system, in particular, an ink jet recording apparatus and an ink jet recording method with which recording is performed onto a recording medium by ejecting ink by means of electrostatic force.

An electrostatic ink jet recording system is a system in which an image is formed on a recording medium by ejecting ink droplets through exertion of electrostatic force on ink in accordance with an image signal and has the following features: simplicity of a head structure; easiness of realization of a multi-channel construction; ability to form fine droplets; and ability to perform high-resolution drawing. As to such an electrostatic ink jet recording system, for instance, U.S. Pat. No. 6,817,692 B (hereinafter referred to as "Patent Document 1") relates to an ink jet recording method, with which the density of ink in the vicinity of openings is increased through electrophoresis of charged particles in an ink flow path and ejection is performed, and discloses an ink jet recording apparatus that includes an ink jet head that performs ejection of ink droplets by means of electrostatic attractive forces mainly ascribable to a recording medium or a counter electrode arranged on the back of the recording medium.

FIG. 18 is an outlined diagram showing a construction of the multi-channel ink jet head disclosed in Patent Document 1 and shows a cross section of an ejection electrode corresponding to a recording head. In the drawing, oil-based ink Q is supplied to a space between a head substrate 202 and an ejection electrode substrate 203 from an ink circulation mechanism 211 including a pump through an ink supply flow path 212 connected to a head block 201, and is recovered to the ink circulation mechanism 211 through an ink recovery flow path 213 also connected to the head block 201. The ejection electrode substrate 203 includes an insulative substrate 204 in which a through hole 207 is formed, and an ejection electrode 209 formed on a surface of the substrate 204 on a recording medium P side to surround the through hole 207.

On the other hand, on the head substrate 202, a projection-shaped ink guide 208 is arranged at substantially the center position of the through hole 207. The projection-shaped ink guide 208 is obtained using an insulative member made of a plastic resin, ceramic, or the like, arranged at the same row interval and pitch so that the center of the ink guide 208 coincides with the center of the through hole 207, and is held on the head substrate 202 with a predetermined method. Each projection-shaped ink guide 208 has a shape in which the tip end of a flat plate having a constant thickness is cut into a triangular shape or a trapezoidal shape, and its tip end portion serves as an ink droplet flying position 210. An ink meniscus is formed between the ink guide 208 and the inner wall surface of the through hole 207. A recording medium P is arranged on a conveyor belt 222 so that it opposes the tip end of the projection-shaped ink guide 208. Also, in a bottom portion of the space between the head substrate 202 and the ejection electrode substrate 203, a migration electrode 205 is formed.

In the ink jet head, at the time of recording, the ink Q supplied from the ink circulation mechanism 211 through the ink supply flow path 212 is supplied to the ink droplet flying position 210 at the tip end of the projection-shaped ink guide 208 through the through hole 207 and a part of the ink Q is recovered to the ink circulation mechanism 211 through the ink recovery flow path 213. Here, to the ejection electrode 209, as a signal voltage corresponding to an image signal from a signal voltage supply 223, a pulse voltage of +500 V is applied at ON time, for instance. When doing so, a voltage of +300 V is applied to the migration electrode 205. On the other hand, the recording medium P is charged to a voltage of −1.7 kV by corona charging means. Now, when the ejection electrode 209 is placed under an ON state (state under which 500 V is applied), an ink droplet R is ejected from the ink droplet flying position 210 at the tip end of the projection-shaped ink guide 208, flies toward the recording medium P, and forms a dot of an image.

With the ink jet recording apparatus disclosed in Patent Document 1, it becomes possible to suppress blurring due to absorption of ink into paper, reduce limitations as to the recording media used, and record images on various recording media.

In addition, coloring particles with increased density are ejected, with the result that a high-density and clear image free from blurring is formed, so it becomes possible to form a high-resolution image not only on dedicated paper for ink jet printing but also on ordinary offset printing paper, plastic film, printing plate for printing, and the like.

The electrostatic ink jet recording apparatus disclosed in Patent Document 1 has the superior features described above, however, it also has a problem that the state of the ink meniscus formed at the ejection port at the time of ejection changes due to an ejection history and the diameter of a formed dot changes, that is, because ink droplet ejection characteristics have ejection frequency dependence (dependence on the number of times of ejection), there are cases where the ejection characteristics change due to the frequency of ejection at each ejection portion.

When the ejection characteristics become unstable in this manner, there occurs a problem that images are not formed on recording media in a constant manner and it becomes impossible to form high-quality images.

The above problems can be solved with a method with which an ejection signal is controlled with reference to an ejection history, however, the method has a problem that a driver becomes complicated and an increase in cost is inevitable.

SUMMARY OF THE INVENTION

It is therefore an object of the present invention to solve the problems of the conventional technique described above by providing inexpensive ink jet recording apparatus and ink jet recording method with which it becomes possible to record high-quality images through electrostatic ink jet recording with stability.

In order to attain the above described object, a first aspect of the present invention provides an ink jet recording apparatus including: conveyor means including an insulative placing portion on which a recording medium onto which an image is recorded is placed, said conveyor means conveying said recording medium placed on said insulative placing portion; an ink jet head disposed at a position opposing said conveyor means and including at least one ejection portion that ejects ink droplets toward said recording medium by exerting electrostatic force on ink in accordance with an image signal; electric field formation means for forming an electric field in said at least one ejection portion during recording of said image; and strong electric field generation means for, immediately before start of image recording onto said recording medium, forming in said ejection portion an electric field having a second electric field strength that is higher than a first electric field strength of said electric field formed by said electric field formation means in said ejection portion in a non-ink droplet ejection period during said recording of said image, and in a first embodiment thereof, there is provided an ink jet recording apparatus including: the above conveyor means; the above ink jet head; and a strong electric field generation means which forms a strong electric field in said ejection portion immediately before said recording medium and said ink jet head are relatively moved to an image recordable position, and wherein said strong electric field generation means includes charge means and a strong electric field formation portion for giving to said ejection portion an electric field strength that is higher than electric field strengths of said recording medium and said insulative placing portion through charging by the charge means.

In the first aspect of the present invention, preferably, said strong electric field generation means forms said electric field having said second electric field strength in said ejection portion immediately before at least one of said recording medium and said ink jet head that is being relatively moved reaches an image recordable position, and more preferably, said electric field having said second electric field strength is momentarily formed in said ejection portion.

In accordance with the first embodiment of the first aspect of the present invention, in the above first aspect, preferably, said strong electric field generation means includes charge means and a strong electric field formation portion that is charged by said charge means, and wherein said strong electric field formation portion forms said electric field having said second electric field strength in said ejection portion by giving to said ejection portion an electric field having an electric field strength that is higher than electric field strengths of electric fields of said recording medium and said insulative placing portion.

In the above first embodiment, preferably, said strong electric field formation portion includes a member whose insulation property is higher than insulation properties of said recording medium and said insulative placing portion, or a member having high insulation property.

Moreover, preferably, said strong electric field formation portion includes a member which is provided to at least a part of said conveyor means and whose insulation property is higher than insulation properties of said recording medium and said insulative placing portion, or a member having high insulation property.

Moreover, preferably, said strong electric field formation portion is a projection portion that is provided to at least a part of said conveyor means and protrudes toward an ink jet head side with respect to said recording medium and said insulative placing portion.

Moreover, preferably, said charge means charges at least one of said recording medium and said insulative placing portion, and charges said strong electric field formation portion so that an electric field, which has an electric field strength that is higher than said electric field strengths of said recording medium and said insulative placing portion, is given to said ejection portion. Alternatively, preferably, said charge means charges at least one of said recording medium and said insulative placing portion to cause electrostatic attraction of said recording medium by said insulative placing portion, and charges said strong electric field formation portion so that said electric field, which has said electric field strength that is higher than said electric field strengths of said electric fields of said recording medium and said insulative placing portion, is given to said ejection portion, and wherein said strong electric field formation portion forms said electric field having said second electric field strength in said ejection portion.

Further, preferably, said conveyor means includes: an insulation layer, which serves as said insulative placing portion on which said recording medium is placed; and a conveyor belt that conveys said recording medium placed on said insulation layer.

In a second embodiment of the first aspect of the present invention, there is provided an ink jet recording apparatus including: the above conveyor means; the above ink jet head; and a strong electric field generation means for, immediately before said recording medium and said ink jet head are relatively moved to an image recordable position, giving to said ejection portion an electric field strength that is higher than an electric field formed in said ejection portion in a non-ink droplet ejection period during said recording of said image onto said recording medium.

In the above second embodiment, preferably, said strong electric field generation means forms said electric field having a high electric field strength, that is, said second electric field strength in said ejection portion immediately before said recording medium reaches said image recordable position, at which said image recording by said ink jet head is possible, through conveying by said conveyor means.

Moreover, in the above second embodiment, preferably, said ink jet head can be scanned in at least one direction with respect to said recording medium, and wherein said strong electric field generation means forms said electric field having a high electric field strength, that is, said second electric field strength in said ejection portion immediately before said ink jet head reaches said image recordable position, at which image recording with respect to said recording medium is possible, through scanning.

Moreover, preferably, an electric field having a high electric field strength, that is, said second electric field strength is momentarily formed in said ejection portion before said recording medium is conveyed to a position opposing said ink jet head.

Moreover, preferably, a part of said conveyor means on a downstream side in a conveying direction with respect to an attached position of said recording medium is charged to a potential that is higher than a potential of said recording medium, and an electric field having a high electric field strength, that is, said second electric field strength is formed in said ejection portion.

Moreover, preferably, a predetermined voltage is applied to the conveyor means, and an electric field having a high electric field strength, that is, said second electric field strength is formed in said ejection portion.

Here, preferably, said conveyor means includes a conveyor belt to which said recording medium is attached, wherein said strong electric field generation means includes charge means for charging at least one of said recording medium and said conveyor belt to cause electrostatic attraction of said recording medium by said conveyor belt, and a charge means control portion that controls said charge means, and wherein said charge means control portion performs control through which at least a part of said conveyor belt on a downstream side in a conveying direction with respect to an attached position of said recording medium is charged to a potential that is higher than a potential of said recording medium.

Moreover, preferably, said conveyor means includes a conveyor belt having: an insulation layer forming a contact surface with said recording medium; and a conductive layer provided on a surface of said insulation layer on a side opposite to said contact surface with said recording medium.

Moreover, preferably, said strong electric field generation means includes a voltage control portion that controls a voltage applied to said conductive layer, and wherein said voltage control portion applies a predetermined voltage to said conductive layer immediately before said recording medium and said ink jet head that are being relatively moved reach said image recordable position.

Moreover, preferably, said conveyor means includes a conveyor belt formed by an insulative member, wherein said strong electric field generation means includes a conductive plate-shaped member arranged in contact with said conveyor belt and provided to a surface of said conveyor belt on a side opposite to an ink jet head side at a position opposing said ink jet head, and a voltage control portion that controls a voltage applied to said conductive plate-shaped member, and wherein said voltage control portion applies a predetermined voltage to said conductive plate-shaped member immediately before said recording medium and said ink jet head that are being relatively moved reach said image recordable position.

Moreover, in both of the embodiment in this aspect, preferably, said ink jet head includes at least one ejection port through which said ink droplets are ejected, and at least one ink guide which passes through said at least one ejection port and whose tip end portion protrudes toward a recording medium side from an opening surface of said at least one ejection port.

Moreover, preferably, said ink jet head includes: an ejection port substrate in which said at least one ejection port is formed; a head substrate which is arranged to be spaced apart from said ejection port substrate by a predetermined distance and forms an ink flow path in a space between said head substrate and said ejection port substrate, said head substrate having said at least one ink guide formed on an ejection port substrate side surface at positions opposing said at least one ejection port; and at least one ejection electrode that is arranged around said at least one ejection port of said ejection port substrate, for controlling said ejection of said ink droplets from said at least one ejection port.

In order to attain the above described object, a second aspect of the present invention provides an ink jet recording method with which an ink jet head records an image onto a recording medium conveyed to a position opposing said ink jet head by conveyor means by ejecting ink droplets from at least one ejection portion toward said recording medium through exertion of electrostatic force on ink in accordance with an image signal, said ink jet recording method including: forming in said ejection portion an electric field having a second electric field strength that is higher than a first electric field strength of an electric field formed in said ejection portion in a non-ink droplet ejection period during recording of said image, immediately before start of said recording of said image onto said recording medium. In a first embodiment thereof, there is provided an ink jet recording method including: making a strong electric field formation portion, which gives to said ejection portion an electric field strength that is higher than that of said recording medium, and passes through a position opposing said ink jet head immediately before said recording medium and said ink jet head are relatively moved to an image recordable position, and in a second embodiment thereof, there is provided an ink jet recording method including: giving said ejection portion an electric field strength that is higher than that formed in said ejection portion in a non-ink droplet ejection period during recording of said image onto said recording medium, immediately before said recording medium and said ink jet head are relatively moved to an image recordable position.

Here, in the second aspect of the present invention, preferably, said electric field having said second electric field strength is formed in said ejection portion immediately before at least one of said recording medium and said ink jet head that is being relatively moved reaches an image recordable position.

Moreover, in accordance with the first embodiment of the second aspect of the present invention, in the above second aspect, preferably, a strong electric field formation portion, which gives to said ejection portion an electric field having an electric field strength that is higher than an electric field strength of an electric field of said recording medium, is passed through a position opposing said ink jet head immediately before at least one of said recording medium and said ink jet head that is being relatively moved reaches said image recordable position.

Moreover, in accordance with the second embodiment of the second aspect of the present invention, in the above second aspect, preferably, said electric field having said second electric field strength is momentarily formed in said ejection portion before said recording medium that is being conveyed reaches a position opposing said ink jet head.

Moreover, preferably, said electric field having a high electric field strength, that is, said second electric field strength is formed in said ejection portion by charging a part of said conveyor means on a downstream side in a conveying direction with respect to an attached position of said recording medium to a potential that is higher than a potential of said recording medium.

Moreover, preferably, said electric field having a high electric field strength, that is, said second electric field strength is formed in said ejection portion by applying a predetermined voltage to said conveyor means.

Moreover, preferably, said ink jet head includes at least one ejection port through which said ink droplets are ejected, and at least one ink guide which passes through said at least one ejection port and whose tip end portion protrudes toward a recording medium side from an opening surface of said at least one ejection port.

DETAILED DESCRIPTION OF THE PREFERRED EMBODIMENTS

Hereinafter, the ink jet recording apparatus according to the first aspect of the present invention and the ink jet recording method according to the second aspect of the present invention will be described in detail on the basis of preferred embodiments illustrated in the accompanying drawings.

Figure 1:
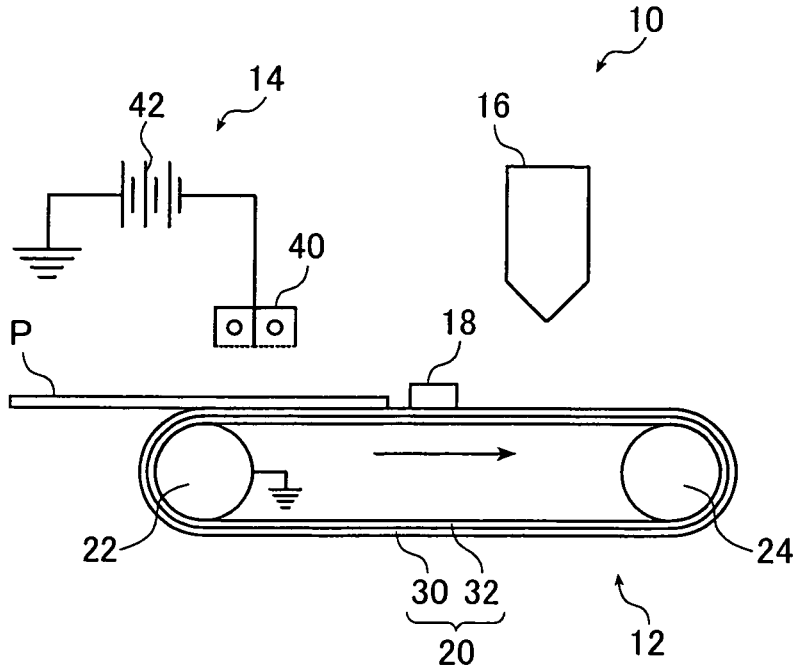
FIG. 1 is a schematic front view showing an outlined construction of one embodiment of an ink jet recording apparatus according to the present invention.

FIG. 1 conceptually shows an ink jet recording apparatus in a first embodiment of the first aspect of the present invention that implements an ink jet recording method in the first embodiment of the second aspect of the present invention.

An ink jet recording apparatus 10 (hereinafter referred to as the "recording apparatus 10") shown in FIG. 1 is an image recording apparatus that uses ink Q obtained by dispersing charged fine particles (hereinafter referred to as the "colorant particles") containing colorants in an insulative carrier liquid (dispersion solvent) and records an image on a recording medium P by ejecting ink droplets through exertion of electrostatic force onto the ink. The recording apparatus 10 basically includes conveyor means 12 for conveying the recording medium P through a predetermined path including a movable conveyor belt 20 the surface of which the recording medium P is attached to and belt rollers 22, 24 for driving the conveyor belt 20, charge means 14 for charging at least one of the recording medium P and the conveyor belt 20 to a predetermined potential, an ejection head (ink jet head) 16 for ejecting ink droplets by exerting electrostatic force onto the ink, and a strong electric field formation portion 18 for giving an electric field, which is stronger than those of the conveyor belt 20 and the recording medium P, to ejection portions of the ejection head 16.

It should be noted that: FIG. 1 mainly shows characteristic sites of the first embodiment of the present invention, however, in addition to the conveyor means 12, the charge means 14, the ejection head 16, and the strong electric field formation portion 18 shown in the FIG. 1, the recording apparatus 10 in the first embodiment of the present invention of course includes various construction elements provided in known electrostatic ink jet recording apparatuses such as a driver for driving the ejection head 16 to eject the ink droplets, electrostatic elimination means for performing electrostatic elimination to at least one of the recording medium P, the conveyor belt 20 and the strong electric field formation portion 18 which are charged, circulation means for performing supply of the ink to the ejection head 16, recovery of the ink used in the ejection head 16, and the like, a sensor for detecting the conveyed recording medium P, and solvent collecting means for collecting such as a carrier liquid remaining in the apparatus.

Further, the ink jet recording apparatus according to the present invention may be a monochrome recording apparatus that performs monochrome image recording using, for example, only K (black) ink or a recording apparatus that records full-color images on a recording medium using ink of four colors of Y (yellow), M (magenta), C (cyan), and K.

Here, as the recording medium P used in the ink jet recording apparatus according to the present invention, there are used fine paper, minutely coated paper, coated paper and the like that are printing paper used as ordinary recording media. In addition, it is also possible to use polyolefin-laminated paper, a plastic film (such as a polyester film, a vinyl chloride film, or a polyolefin film), or the like having a resin film layer on its surface. Still in addition, it is also possible to use a plastic film, converted paper, a printing plate for printing, or the like onto the surface of which a metal is evaporated or metallic foil is laminated. Needless to say, dedicated paper and a dedicated film for ink jet recording are also usable.

As shown in FIG. 1, the conveyor means 12 includes the conveyor belt 20 and the belt rollers 22, 24.

The conveyor belt 20 conveys in a predetermined direction the recording medium P which is placed on the surface of the conveyor belt 20. The conveyor belt 20 is a ring-shaped endless belt and is stretched around the belt rollers 22, 24. The conveyor belt 20 includes an insulating layer 30 and a conductive layer 32, with the insulating layer 30 being provided on a side (front side) contacting the recording medium P. The conductive layer 32 is provided on a side opposite to the side contacting the recording medium P, that is, a side (back side) contacting the belt rollers 22, 24.

The insulating layer 30 is made of material having insulation property, for example, polyimide resin or fluoro resin. Herein, examples of the fluoro resin include polytetrafluoroethylene (PTFE), tetrafluoroethylene-perfluoroalkoxyethylene copolymer (PFA), tetrafluoroethylene-hexafluoropropylene copolymer (FEP), tetrafluoroethylene-ethylene copolymer (ETFE), polychlorotrifluoroethylene (PCTFE), chlorotrifluoroethylene-ethylene copolymer (ECTFE), polyvinylidene fluoride (PVDF), and polyvinyl fluoride (PVF).

Here, in this first embodiment, it is preferable that the intrinsic volume resistivity of the insulating layer 30 of the conveyor belt 20 be set at $10^{14}$ Ω·cm or more. By setting the intrinsic volume resistivity in the range described above, it becomes possible to attach the recording medium P to the conveyor belt 20 with stability.

Also, it is preferable that the thickness of the insulating layer 30 according to the present invention be set at 10 μm to 500 μm and that the surface roughness of the insulating layer 30 be set in a range of average surface roughness Ra≦20 μm. By setting the thickness and surface roughness of the insulating layer 30 in the ranges described above, it becomes possible to obtain superior charge retentivity and durability.

The conductive layer 32 is made of a conductive material such as a flexible metal. More specifically, the conductive layer 32 is made of a stainless thin film, for instance.

It is preferable that the thickness of the conductive layer 32 be set at 10 μm to 200 μm. By setting the thickness of the conductive layer 32 in the range described above, it becomes possible to obtain superior charge retentivity and durability of the conveyor belt.

A method of producing the conveyor belt 20 is not specifically limited. It is possible to employ a method with which the conveyor belt 20 is produced by forming a coating of the resin described above on a metallic conductive layer, a method with which a resin sheet is laminated using an adhesive or the like, or a method with which a metallic layer (conductive layer) is provided for the back surface of the insulating layer through vapor deposition or the like, for instance.

As described above, the conveyor belt 20 is stretched around the two belt rollers 22, 24. At least one of the belt rollers 22, 24 is connected to a driving source (not shown), and is driven to rotate at a predetermined speed during recording. Because of this, the conveyor belt 20 travels around the belt rollers 22, 24 clockwise in FIG. 1.

Further, the belt roller 22 is grounded, so that the potential of the conductive layer 32 which contacts the belt roller 22 is held at a reference potential of 0 V.

The charge means 14 is provided at a position opposed to the surface of the conveyor belt 20 on the insulating layer 30 side, that is, the surface on which the recording medium P is placed. The charge means 14 includes a scorotron charger 40 and a high voltage power source 42. The scorotron charger 40 is provided at a position opposed to the surface of the conveyor belt 20 on the insulating layer 30 side. Furthermore, a terminal on a negative side of the high voltage power source 42 is connected to the scorotron charger 40, and a terminal on a positive side thereof is grounded.

The charge means 14 controls the potential of a grid voltage of the scorotron charger 40 connected to the high voltage power source 42 to uniformly charge the recording medium P and/or the surface of the insulating layer 30 of the conveyor belt 20 to a predetermined potential (negative high voltage in this embodiment). Here, as described above, the potential of the conductive layer 32 of the conveyor belt 20 is held at a reference potential. As a result, the potential, to which the recording medium P and the insulating layer 30 are charged, is stabilized.

Note that the scorotron charger is used as the charge means in the embodiment, however, the present invention is not limited thereto, and hence various charge means such as a corotron charger, a solid-state charger and an electrostatic discharge needle can be used.

The ejection head 16 is for ejecting ink droplets corresponding to image signal to form an image on the recording medium P, and is provided at a position opposed to the conveyor belt 20 on the downstream side of the charge means in a conveying direction of the recording medium P (right side in FIG. 1).

Figure 2A:
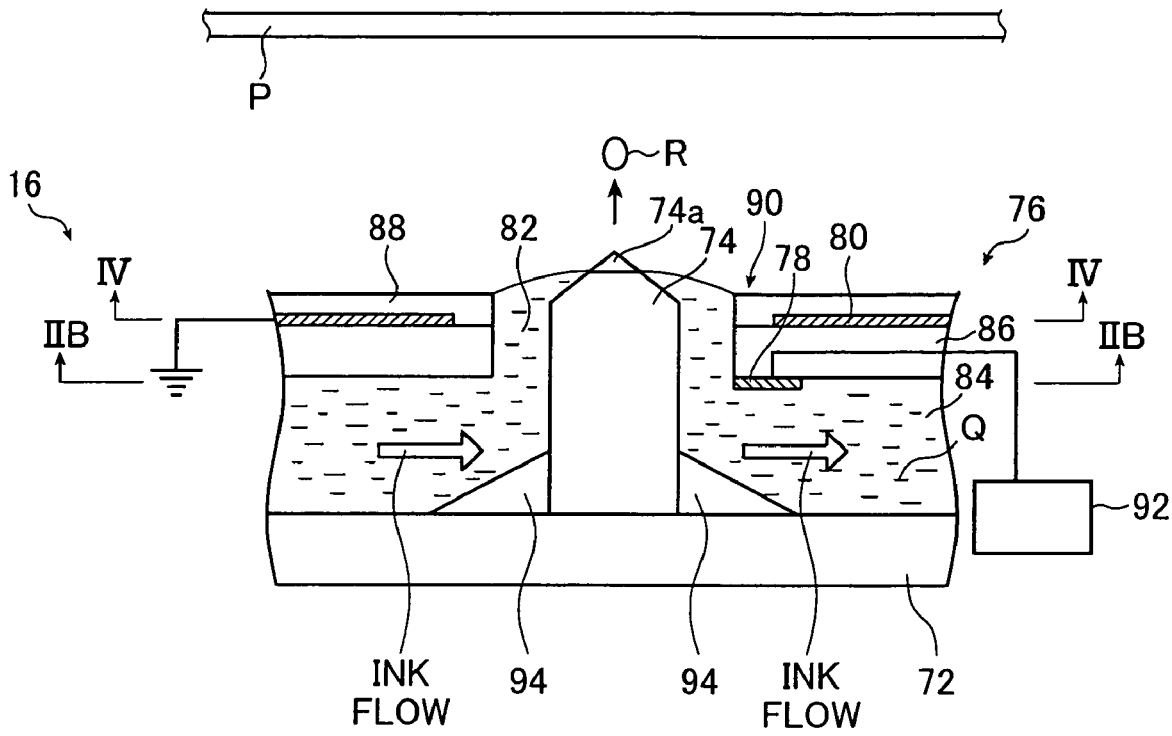
FIGS. 2A and 2B are each a schematic partial cross-sectional view of one embodiment of an ink jet head of the ink jet recording apparatus shown in FIG. 1.
Figure 2B:
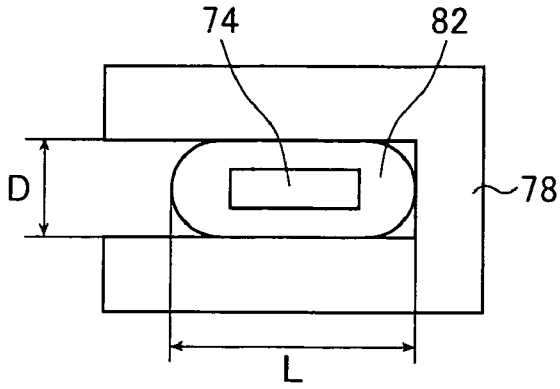

FIG. 2A schematically shows a cross section of an outlined construction of the ejection head and FIG. 2B is a cross-sectional view taken along the line IIB-IIB in FIG. 2A. As shown in FIG. 2A, the ejection head 16 includes a head substrate 72, ink guides 74, and an ejection port substrate 76 in which ejection ports 82 are formed. For the ejection port substrate 76, ejection electrodes 78 are disposed so that each of the ejection electrodes 78 surrounds the ejection port 82.

The head substrate 72 and the ejection port substrate 76 are arranged so as to be spaced apart from each other by a predetermined distance, and an ink flow path 84 for supplying ink to each ejection port 82 is formed utilizing a space formed between the head substrate 72 and the ejection port substrate 76.

Figure 3:
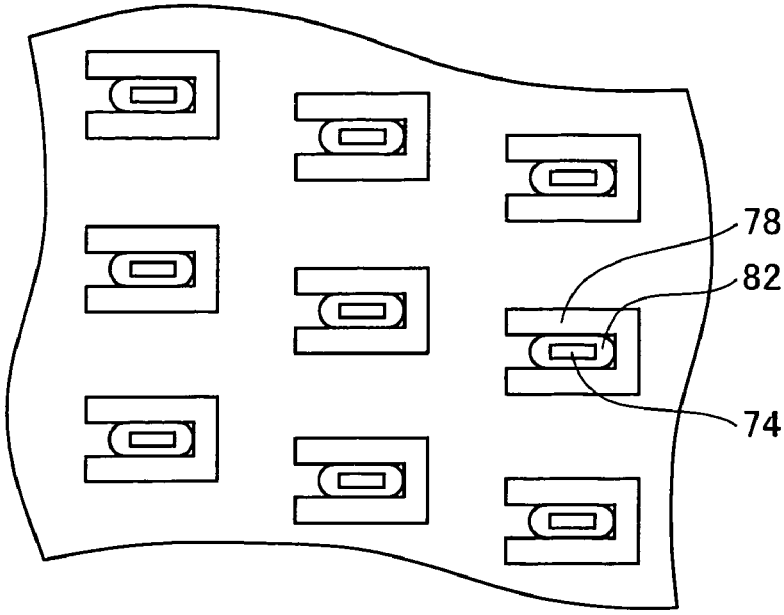
FIG. 3 is a schematic partial plan view of an ejection substrate which is used in the ink jet head having a multi-channel structure shown in FIG. 2A and in which multiple ejection ports are two-dimensionally formed.

In order to perform image recording at a higher density and at high speed, the ejection head 16 has a multi-channel structure in which multiple ejection ports (nozzles) 82 are arranged in a two-dimensional manner. In FIG. 3, a state is schematically shown in which multiple ejection ports 82 are two-dimensionally formed in the ejection port substrate 76 of the ejection head 16. Note that in FIGS. 2A and 2B, for easy-to-understand illustration of the construction of the ink jet head, only one of the multiple ejection ports is shown.

In the ejection head 16 according to the embodiment, it is possible to freely choose the number of the ejection ports 28, the physical arrangement position thereof and the like. For example, the structure may be the multi channel structure shown in FIG. 3 or a structure having only one line of the ejection ports. The ejection head 16 may be a so-called (full-)line head having lines of ejection ports corresponding to the whole area of the recording medium P or a so-called serial head (shuttle type head) which performs scanning in a direction perpendicular to the nozzle line direction. The ink jet head of the present invention can cope with both of a monochrome recording apparatus and a color recording apparatus.

It should be noted here that FIG. 3 shows an arrangement of the ejection ports in a part (three rows and three columns) of the multi-channel structure and, as a preferable form, the ejection ports 82 on a column on the downstream side in a direction of ink flow are disposed so that they are displaced from the ejection ports on a column on an upstream side in the ink flow direction by a predetermined pitch in a direction perpendicular to the ink flow. By disposing the ejection ports on the column on the downstream side so that they are displaced from the ejection ports on the column on the upstream side in the direction perpendicular to the ink flow direction in this manner, it becomes possible to favorably supply the ink to the ejection ports. In the ink jet head according to the present invention, a construction may be used in which an ejection port matrix with n rows and m columns (n and m are each a positive integer), in which ejection ports on a column on the downstream side are disposed so that they are displaced from ejection ports on a column on the upstream side in the direction perpendicular to the ink flow direction, is repeatedly provided with constant cycles in the ink flow direction or a construction may be used instead in which the ejection ports are disposed so that they are successively displaced from ejection ports, which are positioned on the upstream side, in one direction (downward direction or upward direction in FIG. 3) perpendicular to the ink flow. It is possible to appropriately set the number, pitch, and repetition cycle of the ejection ports and the like in accordance with a resolution and a sending pitch.

Also, in FIG. 3, as a preferable form, the ejection ports on the column on the downstream side in the ink flow direction are disposed so that they are displaced from the ejection ports on the column on the upstream side in the direction perpendicular to the ink flow, however, the present invention is not limited to this and the ejection ports on the downstream side and the ejection ports on the upstream side may be disposed on the same straight line in the ink flow direction. In this case, it is preferable that each ejection port on each row be disposed so that it is displaced from ejection ports, which are adjacent to the ejection port in the direction vertical to the ink flow, in the ink flow direction.

In such ejection head 16, ink Q is used in which fine particles (hereinafter referred to as the "colorant particles") containing colorant, such as pigment, and having electrical charges are dispersed in an insulative liquid (carrier liquid). Also, an electric field is generated at the ejection port 82 through application of a drive voltage to the ejection electrode 78 provided for the ejection port substrate 76 and the ink at the ejection port 82 is ejected by means of electrostatic force. Further, by turning on/off the drive voltage applied to the ejection electrode 78 in accordance with image data (ejection on/off), ink droplets are ejected from the ejection port 82 in accordance with the image data and an image is recorded on the recording medium p.

Hereinafter, the structure of the ejection head 16 according to the present invention shown in FIGS. 2A and 2B will be described in more detail.

As shown in FIG. 2A, the ejection port substrate 76 of the ejection head 16 includes an insulation substrate 86, a guard electrode 80, the ejection electrode 78, and an insulating layer 88. On a surface on an upper side in FIG. 2A (surface opposite to a side facing the head substrate 72) of the insulation substrate 86, the guard electrode 80 and the insulating layer 88 are laminated in order. Also, for a surface on a lower side in FIG. 2A (surface on the side opposing the head substrate 72) of the insulation substrate 86, the ejection electrode 78 is formed.

Also, in the ejection port substrate 76, the ejection port 82 for ejecting an ink droplet R is formed so that it passes through the insulation substrate 86. As shown in FIG. 2B, the ejection port 82 is a cocoon-shaped opening (slit), which is narrow and long in the ink flow direction and in which both of short sides of a rectangle are formed in a semicircular shape, and has a shape in which aspect ratio (L/D) between a length L in the ink flow direction and a length D in the direction orthogonal to the ink flow is 1 or more.

In the embodiment, by setting the ejection port 82 as such an opening whose aspect ratio (L/D) between the length L in the ink flow direction and the length D in the direction orthogonal to the ink flow is 1 or more (a shape having shape anisotropy with its long sides extending in the ink flow direction, or a long hole with its long sides extending in the ink flow direction), the ink becomes easy to flow to the ejection port 82. That is, particle supplying property of the ink to the ejection port 82 is enhanced, which makes it possible to improve frequency responsiveness and also prevent clogging. This point will be described in detail later together with an action of ink droplet ejection.

In this embodiment, the ejection port 82 is formed as the long slender cocoon-shaped opening, however, the present invention is not limited to this and it is possible to form the ejection port 82 in another arbitrary shape, such as an approximately circular shape, an oval shape, a rectangular shape, a rhomboid shape, or a parallelogram shape, so long as it is possible to eject the ink from the ejection port 82 and aspect ratio between the length in the ink flow direction and the length in the direction orthogonal to the ink flow is 1 or more. For instance, the ejection port may be formed in a rectangular shape, whose long sides extend in the ink flow direction, or an oval shape or a rhomboid shape whose long axis extends in the ink flow direction. Also, the ejection port may be formed in a trapezoidal shape with its upper base being on the upstream side of the ink flow, its lower base being on the downstream side, and its height in the ink flow direction being set longer than the lower base. In this case, it does not matter whether the side on the upstream side is longer than the side on the downstream side or the side on the downstream side is longer than the side on the upstream side. Further, a shape may be formed in which to each short side of a rectangle whose long sides extend in the ink flow direction, a circle, whose diameter is longer than the short side of the rectangle, is connected. Also, it does not matter whether the ejection port 82 has a shape that is symmetrical about its center between the upstream side and the downstream side or a shape that is asymmetrical about the center therebetween. For example, it may be such that at least one of the end portions of a rectangular ejection port on the upstream side and the downstream side is formed in a semicircular shape.

The ink guide 74 of the ejection head 16 is produced from a ceramic-made flat plate having a predetermined thickness and is disposed on the head substrate 72 for each ejection port 82 (ejection portion). The ink guide 74 is formed so that it has a somewhat wide width in accordance with the length of the cocoon-shaped ejection port 82 in a long-side direction. As described above, the ink guide 74 passes through the ejection port 82 and its tip end portion 74*a* protrudes upwardly from a surface of the ejection port substrate 76 on a recording medium P side (surface of the insulating layer 88).

The tip end portion 74*a* of the ink guide 74 is formed so that it has an approximately triangular shape (or a trapezoidal shape) in which a cross-section parallel to the ink flow direction forms a shape that is gradually narrowed as a distance to the recording medium P (conveyor belt 20) side is reduced. The ink guide 74 is disposed so that a surface of the tip end portion 74*a* is inclined with respect to the ink flow direction. With this construction, the ink flowing into the ejection port 82 moves along the inclined surface of the tip end portion 74*a* of the ink guide 74 and reaches the vertex of the tip end portion 74*a*, so a meniscus of the ink is formed at the ejection port 82 with stability.

Also, by forming the ink guide 74 so that it is wide in the long-side direction of the ejection port 82, it becomes possible to reduce a width in the direction orthogonal to the ink flow and reduce influence on the ink flow, which makes it possible to form the meniscus to be described later with stability.

It should be noted here that the shape of the ink guide 74 is not specifically limited so long as it is possible to cause the colorant particles in the ink Q to pass through the ejection port 82 of the ejection port substrate 76 and be concentrated at the tip end portion 74*a*. For instance, it is possible to change the shape of the ink guide 74 as appropriate to a shape other than the shape in which the tip end portion 74*a* is gradually narrowed toward the recording medium P side. For instance, a slit serving as an ink guide groove that gathers the ink Q to the tip end portion 74*a* by means of a capillary phenomenon may be formed in a center portion of the ink guide 74 in a vertical direction in FIG. 2A.

Also, it is preferable that a metal be evaporated onto the extreme tip end portion of the ink guide 74 because the dielectric constant of the tip end portion 74*a* of the ink guide 74 is substantially increased through the evaporation of the metal onto the extreme tip end portion of the ink guide 74. As a result, a strong electric field is generated at the ink guide 74 with ease, which makes it possible to improve ejection property of the ink.

As shown in FIG. 2B, for the lower surface (surface facing the head substrate 72) of the insulation substrate 86, the ejection electrode 78 is formed. The ejection electrode 78 has a reversed C-letter shape in which one side on the upstream side in the ink flow direction is removed, and is disposed along the rim of the rectangular shaped ejection port 82 so as to surround the periphery of the ejection port 82. Since the ejection electrode 78 is formed such that a part thereof on the upstream side of the ejection port 82 in the ink flow direction is removed, electric field which prevents colorant particles to flow into an ejection port from the upstream side in the ink flow direction is not formed, whereby the colorant particles can be effectively supplied to the ejection port. Moreover, since a part of the ejection electrode 78 is disposed on the downstream side of the ejection port 82 in the ink flow direction, electric field is formed in the direction so that colorant particles flowed into an ejection port is kept at the ejection port. Accordingly, by forming an ejection electrode in a shape in which a part thereof on the upstream side in the ink flow direction is removed, it is also possible to enhance the particle supplying property to an ejection port.

In this embodiment, the ejection electrode 78 is formed in a reversed C-letter shape for obtaining the above effects, however, it is possible to change the ejection electrode 78 to various other shapes so long as the ejection electrode is disposed to face an ink guide. For example, the ejection electrode 78 may be a ring shaped circular electrode, an oval electrode, a divided circular electrode, a parallel electrode, or a substantially parallel electrode corresponding to the shape of the ejection port 82.

As described above, the ejection head 16 has a multi-channel structure in which multiple ejection ports 82 are arranged in a two-dimensional manner. Therefore, as schematically shown in FIG. 3, the ejection electrodes 78 are respectively disposed for the ejection ports 82 in a two-dimensional manner.

Also, the ejection electrodes 78 are exposed to the ink flow path 84 and contact the ink Q flowing in the ink flow path 84. Thus, it becomes possible to significantly improve ejection property of ink droplets. This point will be described in detail later together with an action of ejection. Here, the ejection electrode 78 is not necessarily required to be exposed to the ink flow path 84 and contact the ink. For instance, the ejection electrode 78 may be formed in the ejection port substrate 76 or a surface of the ejection electrode 78 exposed to the ink flow path 84 may be covered with a thin insulating layer.

Also, as shown in FIG. 2A, the ejection electrode 78 is connected to a control unit 92. The control unit 92 is capable of controlling voltages applied to the ejection electrode 78 at the time of ejection of the ink and at the time of non-ejection of the ink.

Figure 4:
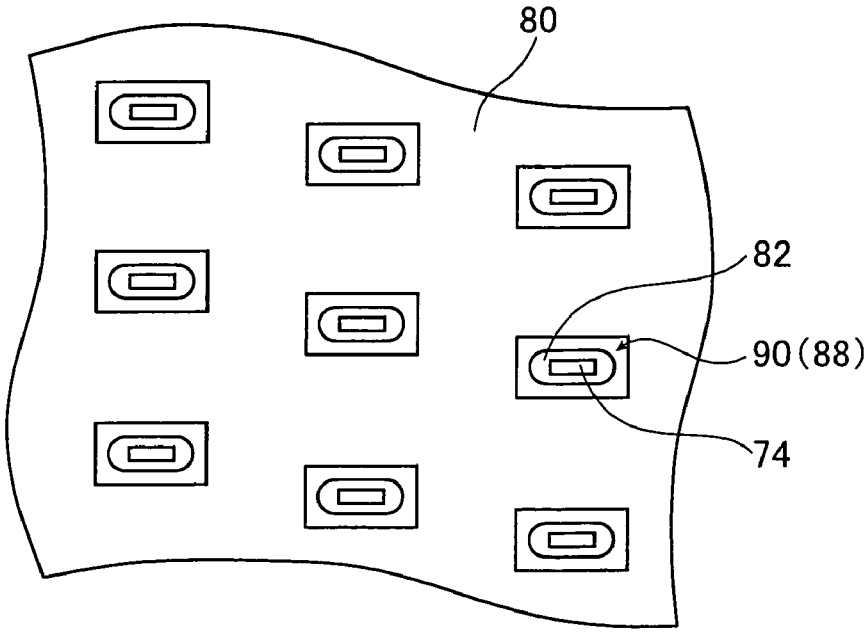
FIG. 4 is a schematic partial plan view of a planar structure of a guard electrode of the ink jet head having a multi-channel structure shown in FIG. 2A.

The guard electrode 80 is formed on a surface of the insulation substrate 86 and a surface of the guard electrode 80 is covered with the insulating layer 88. In FIG. 4, a planar structure of the guard electrode 80 is schematically shown. FIG. 4 is an arrow view taken along the line IV-IV in FIG. 2A and schematically shows the planar structure of the guard electrode 80 of the ink jet head having the multi-channel structure. As shown in FIG. 4, the guard electrode 80 is a sheet-shaped electrode, such as a metallic plate, which is common to each ejection electrode and has openings 90 at positions corresponding to the ejection electrodes 78 respectively formed on the peripheries of the ejection ports 82 arranged in a two-dimensional manner. Each opening 90 of the guard electrode 80 is formed in a rectangular shape. The opening 90 of the guard electrode 80 is formed so that it has a length and a width exceeding the length and the width of the ejection port 82.

It is possible for the guard electrode 80 to suppress electric field interference by shielding against electric lines of force between adjacent ejection electrodes 78, and a predetermined voltage (including 0 v when grounded) is applied to the guard electrode 80. In the illustrated embodiment, the guard electrode 80 is grounded at 0 V.

Preferably, as shown in FIG. 2A, the guard electrode 80 is formed in the layer different from that containing the ejection electrodes 78, and moreover, its whole surface is covered with the insulating layer 88.

The ejection head 16 has the insulating layer 88, whereby the electric field interference between the adjacent ejection electrodes 78 can be suitably prevented, and the colorant particles of the ink Q can be prevented from being disposed to cause the discharge between the ejection electrodes 78 and the guard electrode 80.

Here, the guard electrode 80 needs to be provided so as to shield against the electric lines of force of the ejection electrodes 78 provided on other ejection ports 82 (hereinafter referred to as "other channels") and the electric lines of force directed to the other channels while ensuring the electric lines of force acting on the corresponding ejection port 82 (hereinafter referred to as "own channel" for convenience) among the electric lines of force generated from the ejection electrodes 78.

When the guard electrode 80 is not provided, at the time of ejection of ink droplets, electric lines of force generated from the edge portion on an ejection port side of the ejection electrode 78 (hereinafter referred to as the "inner edge portion of the ejection electrode") converge inside the ejection electrode 78, that is, in an area surrounded by the inner edge portion of the ejection electrode 78, act on the own channel, and generate an electric field necessary for the ink droplet ejection. On the other hand, electric lines of force generated from the edge portion on a side opposite to the ejection port side of the ejection electrode 78 (hereinafter referred to as the "outer edge portion of the ejection electrode") diverge further outside from the outer edge portion of the ejection electrode 78, exert influence on other channels, and cause electric field interference.

If the above points are taken into consideration, the width and the length of the rectangular opening 90 of the guard electrode 80, when the substrate plane is viewed from above, is preferably made larger than the width and the length of the ejection electrode 78 of the own channel to avoid shielding against the electric lines of force directed to the own channel. Specifically, the end portion of the guard electrode 80 on the ejection port 82 side is preferably more spaced apart (retracted) from the ejection port 82 than the inner edge portion of the ejection electrode 78 of the own channel.

In addition, for the efficient shielding against the electric lines of force directed to the other channels, the length and the width of the rectangular opening 90 of the guard electrode 80, when the substrate plane is viewed from above, is preferably made smaller than the spacing between the outer edge portions (outer diameter) of the ejection electrode 78 of the own channel. Specifically, the inner edge portion of the guard electrode 80 is preferably closer (advanced) to the ejection port 82 than the outer edge portion of the ejection electrode 78 of the own channel. According to the studies made by the inventor of the present invention, the distance between the outer edge portion of the ejection electrode 78 and the inner edge portion of the guard electrode 80 is preferably equal to or larger than 5 μm, more preferably equal to or larger than 10 μm.

With the above construction, the stable ejection of the ink droplets from the ejection port 82 is ensured, variations in the ink adhering position due to the electric field interference between the adjacent channels can be suitably suppressed, and thus a high-quality image can be consistently recorded.

The guard electrode 80 may be provided (that is, the opening 90 of the guard electrode 80 may be formed) so that the shape of the opening 90 of the guard electrode 80 is made substantially similar to the shape formed by the inner edge portion or the outer edge portion of the ejection electrode 78, and the inner edge portion of the guard electrode 80 is more spaced apart (retracted) from the ejection port 82 than the inner edge portion of the ejection electrode 78 of the own channel and is closer (advanced) to the ejection port 82 than the outer edge portion of the ejection electrode 78.

Also, in the above example, the guard electrode 80 is made as a sheet-shaped electrode, however, the present invention is not limited to this and the guard electrode 80 may have any other shapes or structures so long as it is possible to shield the respective ejection ports against electric lines of force of other channels. For instance, the guard electrode 80 may be provided between respective ejection ports in a mesh shape. Also, when the intervals between the adjacent ejection ports in the row direction and the intervals between the adjacent ejection ports in the column direction are different from each other in the matrix of the multiple ejection ports, for instance, a construction may be used in which the guard electrode is not provided between ejection ports, which are separated from each other by a degree by which no electric field interference will occur, and the guard electrode is provided only between ejection ports that are close to each other.

Even in this case, it is sufficient that the guard electrode 80 is formed so that the inner edge portion of the guard electrode 80 is more apart from the ejection port 82 than the inner edge portion of the ejection electrode 78 of an own channel and is closer to the ejection port 82 than the outer edge portion of the ejection electrode 78.

Here, the shape of the opening 90 of the guard electrode 80 is set approximately the same as the shape of the ejection port 82, however, the present invention is not limited to this and the opening 90 of the guard electrode 80 may have another arbitrary shape so long as it is possible to prevent electric field interference by shielding against electric lines of force between adjacent ejection electrodes 78. For instance, it is possible to form the opening 90 in a circular shape, an oval shape, a square shape, or a rhomboid shape.

In the ejection head 16 in this embodiment, as a preferable form, ink guide dikes 94 that induce the ink to the ejection port 82 are provided for the head substrate 72. The ink guide dikes 94 will be described in detail below.

Figure 5A:
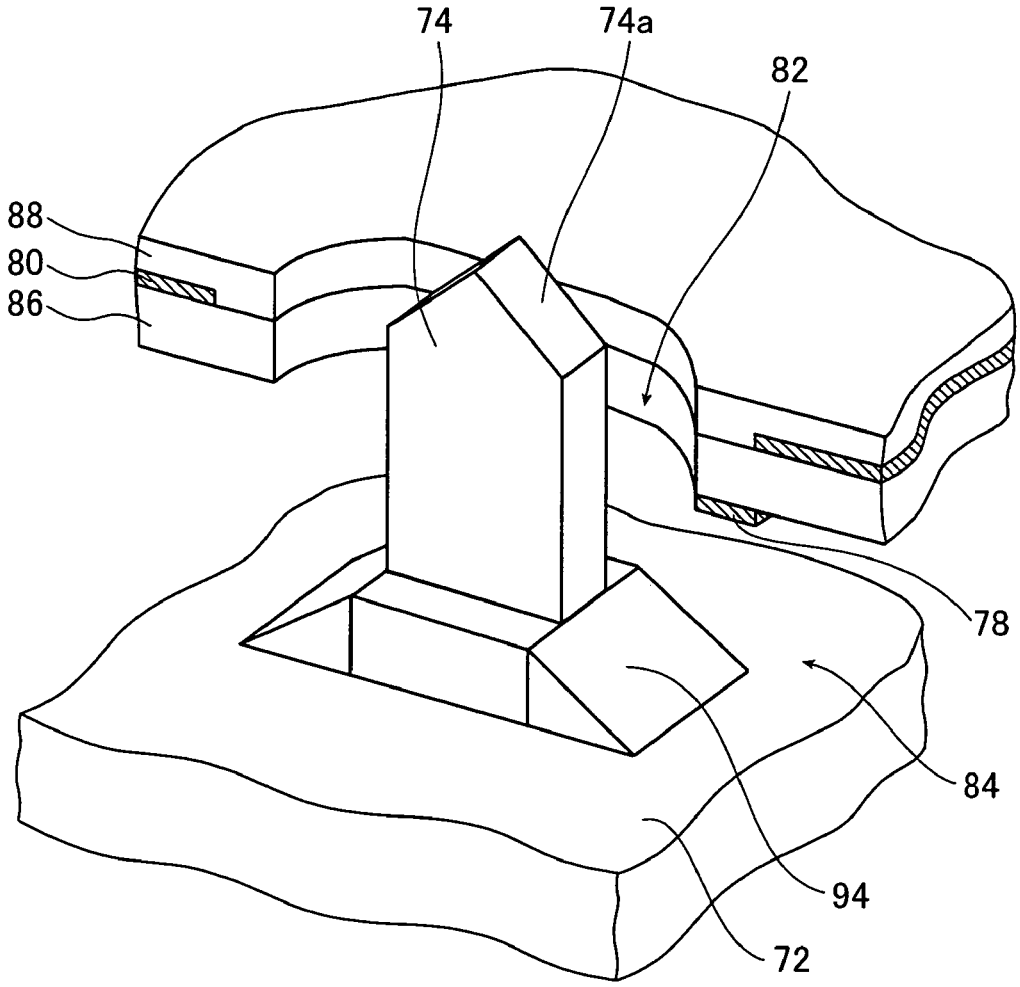
FIG. 5A is a partial cross-sectional perspective view showing a construction of the ink jet head shown in FIG. 2A at a portion in proximity to an ejection portion.

FIG. 5A is a partial cross sectional perspective view showing a construction of the vicinity of the ejection portion in the ejection head 16 shown in FIG. 2A. In FIG. 5A, in order to demonstrate clearly the structure of the ink guide dike 94, the ejection port substrate 76 is cut off in a nearly central position of the ink guide 74 along a direction of the ink flow.

The ink guide dikes 94 are respectively provided on upstream and downstream sides of the ink guide 74 in the direction of the ink flow on a surface on the ink flow path 84 side of the head substrate 72, i.e., on a bottom surface of the ink flow path 84. Also, each ink guide dike 94 has a surface which inclines so as to become gradually closer to the ejection port substrate 76 from the vicinity of the position corresponding to the ejection port 82 toward the position corresponding to the center of the ejection port 82 with respect to the direction of the ink flow. That is to say, each ink guide dike 94 has such a shape as to incline toward the ejection port 82 along the direction of the ink flow.

In addition, each ink guide dike 94 is constructed so as to have nearly the same width as that of the ejection port 82 in a direction intersecting perpendicularly the direction of the ink flow, and have a side wall which is erected from the bottom face. In addition, the ink guide dikes 94 are provided at a predetermined distance from the surface of the ejection port substrate 76 on the ink flow path 84 side, i.e., the upper surface of the ink flow path 84 so as to ensure the flow path of the ink Q without blocking up the ejection port 82. Such ink guide dikes 94 are provided for the respective ejection portions.

The ink guide dikes 94 inclining toward the ejection port 82 are provided on the bottom surface of the ink flow path 84 along the direction of the ink flow, whereby the ink flow directed to the ejection port 82 is formed and hence the ink Q is guided to the opening portion of the ejection port 82 on the side of the ink flow path 84. Thus, it is possible to suitably make the Ink Q to flow to the inside of the ejection port 82, and it is also possible to enhance the particle supplying property of the ink Q. Further, it is possible to more surely prevent the ejection port 82 from being clogged.

Figure 5B:
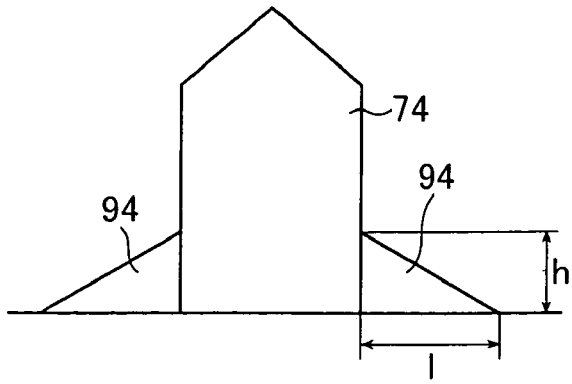
FIG. 5B is an explanatory diagram of the shape and dimensions of an ink guide dike of the ink jet head shown in FIG. 5A.

A length l of the ink guide dike 94 in the direction of the ink flow has to be suitably set so as to suitably guide the ink Q to the ejection port 82 within a range of not interfering with any of the adjacent ejection ports. Thus, as shown in FIG. 5B, the length l of the ink guide dike 94 is preferably 3 or more times as large as a height h ($1/h \geqq 3$) of a highest portion of the ink guide dike 94, and is more preferably 8 or more times as large as the height h ($1/h \geqq 8$) of the highest portion of the ink guide dike 94.

A width of the ink guide dike 94 in the direction intersecting perpendicularly the direction of the ink flow is preferably equal to that of the ejection port 82 or slightly wider than that of the ejection port 82. In addition, the ink guide dike 94 is not limited to the illustrated example having a uniform width. Thus, there may also be adopted an ink guide dike having a gradually decreasing width, an ink guide dike having a gradually increasing width, or the like. In addition, each side wall of the ink guide dike 94 is not limited to the vertical plane, and hence may also be an inclined plane or the like.

An inclined plane (ink guide surface) of the ink guide dike 94 need only have a shape which is suitable for guiding the ink Q to the ejection port 82. Thus, a slope having a fixed angle of inclination may be adopted for the inclined plane of the ink guide dike 94. Or, a surface having a changing angle of inclination, or a curved surface may also be adopted for the inclined plane of the ink guide dike 94. In addition, the surface of the inclined plane of the ink guide dike 94 is not limited to a smooth surface. Thus, one or more ridges, grooves or the like may be formed along the direction of the ink flow, or radially toward the central portion of the ejection port 82 on the inclined plane of the ink guide dike 94.

In addition, the upper portion of the ink guide dike 94 and the ink guide 74 may also be smoothly connected to each other without creating a step in the vicinity of a connection portion between the upper portion of the ink guide dike 94 and the ink guide 74 as in the illustrated example.

In the illustrated example, there is adopted a form in which the ink guide dikes 94 are disposed on the upstream and downstream sides of the ink guide 74, respectively. However, alternatively, there may also be adopted a form in which a trapezoidal ink guide dike 94 having slopes on the upstream and downstream sides of the ejection port 82, respectively, is provided, and the ink guide 74 is erected on the upper portion of this trapezoidal ink guide dike 94. Or, the ink guide 74 and the ink guide dike 94 may also be formed integrally with each other. As described above, the ink guide dike 94 may be formed separately from or integrally with the ink guide 74 to be mounted to the head substrate 72, or may also be formed by digging the head substrate 72 using the conventionally known digging means.

It should be noted that while the ink guide dike 94 has to be provided on the upstream side of the ejection port 82, as in the illustrated example, the ink guide dike 94 is preferably provided on the downstream side as well of the ejection port 82 so that its height in the direction of ejection of the ink droplet R becomes lower with increasing a distance from the ejection port 82. As a result, the ink Q which has been guided toward the ejection port 82 by the ink guide dike 94 on the upstream side smoothly flows into the downstream side. Hence, the stability of the ink flow can be held and also the stability of ejection of the ink Q can be maintained without a turbulent flow of the ink Q.

In the example shown in FIG. 5A, the ink guide dikes 94 are disposed on the upper surface of the head substrate 72. However, the present invention is not limited to this and there may also be adopted a construction in which an ink flow groove is provided in the head substrate 72, and the ink guide dikes are disposed inside the ink flow groove.

For example, the ink flow groove having a predetermined depth is provided so as to extend through a position corresponding to the ejection port 82 along the direction of the ink flow. Further, there are provided ink guide dikes having the surfaces inclining toward the ejection port 82 along the direction of the ink flow in the position corresponding to the ejection port 82 of the ink groove. In such a manner, the provision of the ink flow groove can make most of the ink Q flowing through the ink flow path 84 selectively flow in the ink flow groove, and the provision of the ink guide dikes can make the ink Q suitably flow to the inside of the ejection port 82. Hence, it is possible to enhance the supplying property of the ink to the tip portion 74*a* of the ink guide 74.

In the electrostatic ink jet recording system in which the ink Q containing colorant particles as described above is used, there is not adopted the process in which a force is caused to act on the overall ink to fly the ink towards the recording medium as in a conventional ink jet system, but there is adopted the process in which a force is caused to mainly act on the colorant particles as the solid components dispersed into the carrier liquid to fly the ink droplets. The ejection action of ink droplets R from the ejection head 16 will be described below.

As shown in FIG. 2A, the ink Q containing colorant particles charged in the same polarity as that of the voltage to be applied to the ejection electrode 78 at the time of recording, for example positively charged colorant particles is circulated by an ink circulating mechanism including a pump (not shown) and the like in a direction shown by an arrow (from the left to the right in FIG. 2A) in the ink flow path 84.

On the other hand, upon recording, as described above, the recording medium P is charged to have the polarity opposite to that of the colorant particles, that is, a negative high voltage (for example, −2.2 kV) by the charge means 14. While being charged to the bias voltage, the recording medium P is electrostatically attracted to the conveyor belt 20.

In this state, the recording medium P (conveyor belt 20) and the ejection head 16 are moved relatively while the control unit 92 performs control so that a pulse voltage (hereinafter referred to as a "drive voltage") is applied to each ejection electrode 78 in accordance with supplied image data. Ejection ON/OFF is basically controlled depending on whether or not the drive voltage is applied, whereby the ink droplets R are ejected in accordance with the image data to record an image on the recording medium P.

Here, when the drive voltage is not applied to the ejection electrode 78 (or the applied voltage is at a low voltage level), i.e., in a state where the bias voltage is only applied to the conveyor belt 20 (or the conveyor belt 20 and the ejection electrode 78), Coulomb attraction acting between the conveying belt 20 and the colorant particles (charged particles) of the ink Q, Coulomb repulsion among the colorant particles, viscosity, surface tension and dielectric polarization force of the carrier liquid, and the like act on the ink Q, and these forces operate in conjunction with one another to move the colorant particles and the carrier liquid. Thus, the balance is kept in a meniscus shape as conceptually shown in FIG. 2A in which the ink Q slightly rises from the ejection port 82.

The colorant particles aggregate in the ejection port 82 due to the electric field generated from the ejection electrode 78. Then, the colorant particles move toward the recording P charged to the bias voltage through a so-called electrophoresis process by the above described Coulomb attraction and the like. Therefore, the ink Q is concentrated at the meniscus formed in the ejection port 82.

From this state, the drive voltage is applied to the ejection electrode 78. As a result, the drive voltage is superposed on the bias voltage, and the motion occurs in which the previous conjunction motion operates in conjunction with the superposition of the drive voltage. Then, electrostatic force acts on the colorant particles and the carrier liquid by the electric field generated by the application of the drive voltage to the ejection electrode 78. Thus, the colorant particles and the carrier liquid are attracted toward the bias voltage side (the conveyor belt 20 side), i.e., the recording medium P side by the electrostatic force. The meniscus formed in the ejection port 82 grows upward to form a nearly conical ink liquid column, i.e., the so-called Taylor cone above the ejection port 82. In addition, similarly to the foregoing, the colorant particles are moved to the meniscus surface through the electrophoresis process and the action of the electric field from the ejection electrode so that the ink Q at the meniscus is concentrated and has a large number of colorant particles at a nearly uniform high concentration.

When a finite period of time further elapses after the start of the application of the drive voltage to the ejection electrode 78, the balance mainly between the force acting on the colorant particles (Coulomb force and the like) and the surface tension of the carrier liquid is broken at the tip portion of the meniscus having the high electric field strength due to the movement of the colorant particles or the like. As a result, the meniscus abruptly grows to form a slender ink liquid column called the thread having about several μm to several tens of μm in diameter.

When a finite period of time further elapses, the thread grows, and is divided due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. The divided thread is then ejected and flown in the form of the ink droplets R and is attracted by the bias voltage as well to adhere to the recording medium P. The growth of the thread and its division, and moreover the movement of the colorant particles to the meniscus and/or the thread are continuously generated while the drive voltage is applied to the ejection electrode. Therefore, the amount of ink droplets ejected per pixel or per dot can be controlled by adjusting the time when the drive voltage is applied.

After the end of the application of the drive voltage (ejection is OFF), the meniscus returns to the above-mentioned state where only the bias voltage is applied.

As shown in FIGS. 2A and 2B, the ejection port 82 of the ink jet head in this embodiment has a slit-like slender-hole shape with respect to the ink flow direction. By forming the ejection port 82 into such a slit-like slender-hole shape, that is, a shape in which an aspect ratio between a length in the ink flow direction and a length in the direction orthogonal to the ink flow is 1 or more, the ink readily enters the ejection port 82 and the ink supplying property to the ejection port 82 is enhanced. Thus, the ink particles supplying property to the tip end portion 74*a* is also enhanced. Thus, the ejection frequency during image recording is improved, so that even if the ink droplets are continuously ejected at a high speed, dots of desired size can be consistently formed on the recording medium. In addition, by setting the aspect ratio of the ejection port 82 at 1 or more, the ink flows smoothly and the ejection port 82 can be prevented from being clogged with the ink. Further, by setting the aspect ratio of the ejection port 82 at 1.5 or more, it becomes possible to further enhance ink supplying property to the ink guides, and form successive large dots on the image recording medium with stability. As a result, it becomes possible to draw an image at a higher drawing frequency.

Taking the image output time into account, the ejection frequency is 5 kHz, preferably 10 kHz and more preferably 15 kHz.

Here, as described above, by forming the opening shape of the ejection port 82 into a shape in which the aspect ratio between the length in the ink flow direction and the length in the direction orthogonal to the ink flow is 1 or more, the above effect can be more suitably obtained. However, the ink jet head of this embodiment is not limited thereto. The opening shape of the ejection port 82 may be such that the aspect ratio between a major axis and a minor axis thereof is 1 or more. In this case, the ink can flow smoothly and the ejection port 82 can be prevented from being clogged with the ink.

In the ejection head 16 shown in FIGS. 2A and 2B, the ejection electrode 78 is exposed to the ink flow path 84 and hence in contact with the ink Q in the ink flow path 84.

Therefore, when the drive voltage is applied to the ejection electrode 78 that is in contact with the ink Q in the ink flow path 84 (ejection is ON), a part of electric charges supplied to the ejection electrode 78 is injected into the ink Q, which increases the electric conductivity of the ink Q which is located between the ejection port 82 and the ejection electrode 78. Therefore, in the ejection head 16 of this embodiment, the ink Q is readily ejected in the form of the ink droplets R (ejection property is enhanced) when the drive voltage is applied to the ejection electrode 78 (when the ejection is ON).

Further, at the time of non-ejection of the ink, that is, when the drive voltage is not applied, by applying a voltage which is identical in polarity to that of the colorant particles to the reversed C-letter shaped ejection electrode 78, electric charges are injected into the ink Q even at the time of non-ejection of the ink, which further increases the electric conductivity of the ink Q. Therefore, the charged colorant particles which float in the ink flowing from the upstream side can be surely kept at the ejection portion 82 by the electrostatic force generated from the ejection electrode 78.

Next, the ink used in the ejection head 16 of this embodiment will be described.

The ink Q is obtained by dispersing colorant particles in a carrier liquid. The carrier liquid is preferably a dielectric liquid (non-aqueous solvent) having a high electrical resistivity (equal to or larger than $10^9$ Ω·cm, and more preferably equal to or larger than $10^{10}$ Ω·cm). If the electrical resistance of the carrier liquid is low, the concentration of the colorant particles does not occur since the carrier liquid receives the injection of the electric charges and is charged due to a drive voltage applied to the ejection electrodes. In addition, since there is also anxiety that the carrier liquid having a low electrical resistance causes the electrical conduction between the adjacent ejection electrodes, the carrier liquid having a low electrical resistance is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the colorant particles contained in the carrier liquid to facilitate the electrophoresis of the colorant particles.

Note that the upper limit of the specific electrical resistance of the carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of the ink under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as the carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid, but dispersion resin particles are preferably contained for enhancement of fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the colorants, pigments and dyes conventionally used in ink compositions for ink jet recording, (oily) ink compositions for printing, or liquid developers for electrostatic photography may be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of dispersion resin particles include rosins, rosin-modified phenol resin, alkyd resin, a (meth) acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, the content of colorant particles (total content of colorant particles and dispersion resin particles) preferably falls within a range of 0.5 to 30.0 wt % for the overall ink, more preferably falls within a range of 1.5 to 25.0 wt %, and much more preferably falls within a range of 3.0 to 20.0 wt %. If the content of colorant particles decreases, the following problems become easy to arise. The density of the printed image is insufficient, the affinity between the ink Q and the surface of the recording medium P becomes difficult to obtain to prevent the image firmly stuck to the surface of the recording medium P from being obtained, and so forth. On the other hand, if the content of colorant particles increases, problems occur in that the uniform dispersion liquid becomes difficult to obtain, the clogging of the ink Q is easy to occur in the ink jet head or the like to make it difficult to obtain the consistent ink ejection, and so forth.

In addition, the average particle diameter of the colorant particles dispersed in the carrier liquid preferably falls within a range of 0.1 to 5.0 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA Ltd.).

After the colorant particles and optionally a dispersing agent are dispersed in the carrier liquid, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colorant particles may be positively or negatively charged as long as the charged colorant particles are identical in polarity to the drive voltages applied to ejection electrodes.

In addition, the charging amount of colorant particles is preferably in a range of 5 to 200 μC/g, more preferably in a range of 10 to 150 μC/g, and much more preferably in a range of 15 to 100 μC/g.

In addition, the electrical resistance of the dielectric solvent may be changed by adding the charging control agent in some cases. Thus, the distribution factor P defined below is preferably equal to or larger than 50%, more preferably equal to or larger than 60%, and much more preferably equal to or larger than 70%.

$$P=100\times(\sigma1-\sigma2)/\sigma1$$

where σ1 is an electric conductivity of the ink Q, and σ2 is an electric conductivity of a supernatant liquid which is obtained by inspecting the ink Q with a centrifugal separator. Those electric conductivities were obtained by measuring the electric conductivities of the ink Q and the supernatant liquid under a condition of an applied voltage of 5 V and a frequency of 1 kHz using an LCR meter (AG-4311 manufactured by ANDO ELECTRIC CO., LTD.) and electrode for liquid (LP-05 manufactured by KAWAGUCHI ELECTRIC WORKS, CO., LTD.). In addition, the centrifugation was carried out for 30 minutes under a condition of a rotational speed of 14,500 rpm and a temperature of 23° C. using a miniature high speed cooling centrifugal machine (SRX-201 manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between the adjacent ejection electrodes.

In addition, the surface tension of the ink Q is preferably in a range of 15 to 50 mN/m, more preferably in a range of 15.5 to 45.0 mN/m, and much more preferably in a range of 16 to 40 mN/m. The surface tension is set in this range, resulting in that the applied voltages to the ejection electrodes are not excessively high, and also the ink does not leak or spread to the periphery of the head to contaminate the head.

Moreover, the viscosity of the ink Q is preferably in a range of 0.5 to 5.0 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to the dispersion medium to allow the colorant particles to be charged. The following methods are given as the specific methods.

(1) A method including: previously mixing (kneading) a colorant and optionally dispersion resin particles; dispersing the resultant mixture into a carrier liquid using a dispersing agent when necessary; and adding the charging control agent thereto.

(2) A method including: adding a colorant and optionally dispersion resin particles and a dispersing agent into a carrier liquid at the same time for dispersion; and adding the charging control agent thereto.

(3) A method including adding a colorant and the charging control agent and optionally the dispersion resin particles and the dispersing agent into a carrier liquid at the same time for dispersion.

In the electrostatic ink jet recording apparatus, in ordinary cases, an image is formed on the recording medium P by ejecting ink droplets from the ejection head 16 in accordance with an image signal in the manner described above while conveying the recording medium P with the conveyor belt 20. In the case of such an electrostatic ink jet recording apparatus, however, there is a problem in that ejection characteristics change depending on an ejection history of the ejection head, ejection of ink droplets becomes unstable, and it becomes impossible to form high-quality images. That is, there is a problem that the ink droplet ejection has ejection frequency dependence.

The inventor of the present invention has found as a result of earnest consideration that the ejection characteristics described above (frequency dependence, dependence on the number of times of ejection) are ascribable to the wet state of the ejection portion, in particular, the wet state of the ink guide and that when the number of times of ejection is small, that is, the ejection frequency is low (time intervals between ejections are long), the ejection portion, in particular, the tip end portion of the ink guide dries, which results in the above problem.

Therefore, in this first embodiment of the present invention, as strong electric field generation means for preventing the ejection portion, such as the tip end portion of the ink guide, from drying by wetting the tip end portion of the ink guide with the ink through formation of a strong electric field in the ejection portion of the ejection head before the recording medium P is conveyed to a position opposing the ejection head and an image is formed on the recording medium P, there is provided the strong electric field formation portion 18 which gives an electric field intensity that is stronger than those of the recording medium P and the insulating layer 30 to the ejection portion of the ejection head 16.

Hereinafter, the strong electric field formation portion 18 will be described in detail.

As shown in FIG. 1, the strong electric field formation portion 18 is arranged on the conveyor belt 20 on the downstream side in the conveying direction with respect to an attached position of the recording medium P to the conveyor belt 20, and is constructed using a member having charging property that is higher than those of the recording medium P and the insulating layer 30. Here, the strong electric field formation portion 18 is made of an insulative material such as a polyimide resin or a fluoro resin. Herein, examples of the fluoro resin include polytetrafluoroethylene (PTFE), tetrafluoroethylene-perfluoroalkoxyethylene copolymer (PFA), tetrafluoroethylene-hexafluoropropylene copolymer, (FEP), tetrafluoroethylene-ethylene copolymer (ETFE), polychlorotrifluoroethylene (PCTFE), chlorotrifluoroethylene-ethylene copolymer (ECTFE), polyvinylidene fluoride (PVDF), and polyvinyl fluoride (PVF).

Here, it is preferable that the intrinsic volume resistivity of the strong electric field formation portion 18 be set higher than that of the insulating layer 30 and that the intrinsic volume resistivity be set at $10^{15}$ Ω·cm or more. By setting the intrinsic volume resistivity in the range described above, it becomes possible to achieve high potential retentivity, thus enabling to suitably charge the strong electric field formation portion 18 to a high potential.

The strong electric field formation portion 18 moves along with the movement of the conveyor means 12, and is charged to a predetermined potential by the charge means 14 when passing through a position opposing the charge means 14. The strong electric field formation portion 18 has charging property that is higher than those of the recording medium P and the insulating layer 30, so the electric field formation portion 18 is charged to a potential that is higher than those of the recording medium P and the insulating layer 30.

The strong electric field formation portion 18 thus charged to the high potential by the charge means 14 is conveyed to the position opposing the ejection head 16 and passes through the opposing position before recording is performed onto the recording medium P. When the strong electric field formation portion 18 is conveyed to the position opposing the ejection head 16, an electric field, that is stronger than those at the time of passage of the conveyor belt 20 and in the case where the recording medium P opposes the ejection head 16, is formed between the ejection head 16 and the strong electric field formation portion 18. Through the formation of the strong electric field between the ejection head 16 and the strong electric field formation portion 18, the ink at the ejection port 82 of the ejection head 16 is attracted toward the strong electric field formation portion 18 side, that is, the conveyor belt 20 side, and moves up to the tip end portion 74*a* of the ink guide 74 of the ejection head 16, whereby the tip end portion 74*a* of the ink guide 74 is placed under an ink-wet state.

In this first embodiment of the present invention, by charging the strong electric field formation portion to a high potential and causing the strong electric field formation portion to pass through the position opposing the ejection head before recording is performed onto the recording medium in the manner described above, the tip end portion of the ink guide of the ejection portion of the ejection head is placed under the ink-wet state before recording is performed onto the recording medium P. As a result, regardless of an ejection history and ejection intervals, the wet state of the tip end portion of the ink guide (ejection portion) of the ejection head at the time of recording becomes constant, making it possible to eject ink droplets with constant ejection characteristics.

As described above, according to the present invention, it becomes possible to enhance drawing stability and form a high-quality image on a recording medium with stability. Also, it becomes possible to set the ejection characteristics constant without performing control of the ejection head. As a result, it becomes possible to control ejection of ink droplets with a simple driver and achieve an apparatus cost reduction.

In addition, even if an ejection portion exists that does not eject an ink droplet for a long time, each time the strong electric field formation portion passes through the position opposing the ejection head, every ejection portion is placed under the wet state, so it becomes possible to prevent clogging of an ejection port ascribable to a state in which ink droplet ejection is not performed for a long time and the like from occurring.

Here, even when ink droplets are ejected from the ejection head 16 at the time the strong electric field formation portion 18 passes through the position opposing the ejection head 16, no influence is exerted on an image to be recorded on the recording medium P, so the strong electric field formation portion 18 may be charged to a potential at which an electric field with which ink droplets are ejected is formed. Also, by ejecting ink droplets from the ejection head 16 at the time the strong electric field formation portion 18 passes through the position opposing the ejection head 16, it becomes possible to wet the tip end portion of the ink guide with reliability.

Also, in the embodiment described above, the strong electric field formation portion 18 on the conveyor belt 20 is conveyed and is passed through the position opposing the ejection head 16. However, the present invention is not limited to this and it is sufficient that immediately before the recording medium P and the ejection head 16 are relatively moved to an image recordable position, a strong electric field intensity is given to the ejection portion by the strong electric field formation portion 18 at the position opposing the ejection head. Therefore, the ejection head 16 may be moved or the strong electric field formation portion 18 may be moved independently.

FIGS. 6A to 6D are each a perspective view schematically showing an arrangement example of the strong electric field formation portion 18.

Figure 6A:
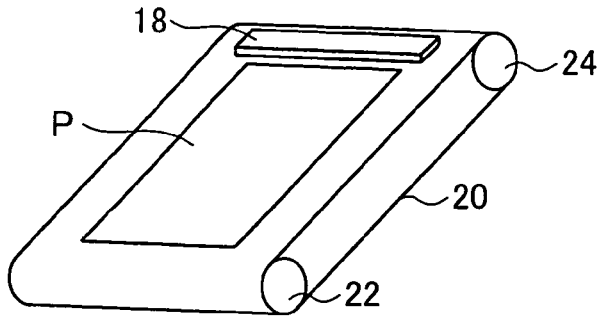
FIGS. 6A to 6D are each a perspective view schematically showing an arrangement example of a strong electric field formation portion of the ink jet recording apparatus shown in FIG. 1.
Figure 6B:
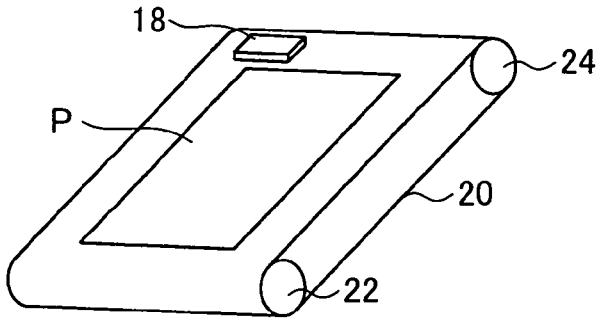

It is preferable that a width of the strong electric field formation portion 18 in a direction orthogonal to the conveying direction of the recording medium be set wider than that of the ejection head. That is, in the case of a line head like the head in this embodiment, as shown in FIG. 6A, it is preferable that the strong electric field formation portion 18 be provided to have a length approximately the same as that of the conveyor belt 20 in a width direction, that is, the direction orthogonal to the conveying direction.

By setting the width of the strong electric field formation portion in the direction orthogonal to the conveying direction to be wider than that of the ejection head in the direction orthogonal to the conveying direction in the manner described above, it becomes possible to generate a strong electric field in every ejection portion of the ejection head only through movement of the strong electric field formation portion by the conveyor belt, that is, without moving the ejection head, thereby placing the tip end portion of every ink guide (every ejection portion) under the ink-wet state.

Also, when the ejection head is a serial head as described above, as shown in FIG. 6B, by providing the strong electric field formation portion 18 having a width that is at least equal to or more than that of the ejection head on the conveyor belt 20, it becomes possible to achieve the effects of the present invention.

Figure 6C:
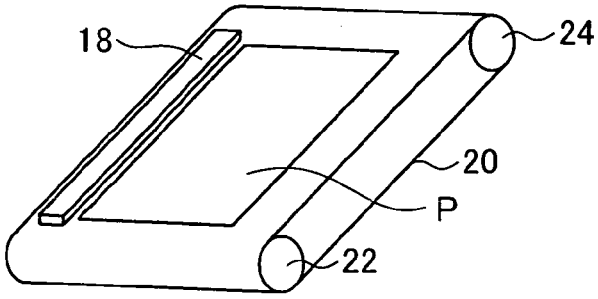

Further, in the case of the serial head, the present invention is not limited to the embodiment described above. As shown in FIG. 6C, the strong electric field formation portion 18 may be provided in an end portion of the conveyor belt 20 in the direction orthogonal to the conveying direction of the recording medium P to extend in the conveying direction of the recording medium P.

In the case of providing the strong electric field formation portion 18 in the manner described above, when an image is recorded onto the recording medium P by scanning the ejection head 16 in the direction orthogonal to the conveying direction of the recording medium P, the ejection head 16 is moved to a position opposing the strong electric field formation portion 18. Whereby, it becomes possible to form a strong electric field in the ejection portion of the ejection head 16 immediately before the recording medium P and the ejection head 16 are relatively moved to the image recordable position also at the time of image recording onto the recording medium P, which makes it possible to set the ejection characteristics of the ejection portion constant. As a result, it becomes possible to further improve the drawing stability.

Here, in the present invention, it is sufficient that a strong electric field is formed in every ejection portion of the ejection head 16 at least before recording is performed onto the recording medium P. That is, the number of times, frequency, and the like of movement of the ejection head 16 to the position opposing the strong electric field formation portion 18 to generate the strong electric field in the ejection portion of the ejection head 16 are not specifically limited. Therefore, the ejection head 16 may be moved to the position opposing the strong electric field formation portion 18 each time a scanning operation of the ejection head 16 is performed or the ejection head 16 may be moved to the position opposing the strong electric field formation portion 18 each time a predetermined number of scanning operations of the ejection head 16 is performed.

Also, it is possible to set the length of the strong electric field formation portion 18 in a longitudinal direction at an arbitrary length such as a length, which is approximately the same as that of the recording medium P in the conveying direction, or the whole circumferential length of the conveyor belt 20.

Figure 6D:
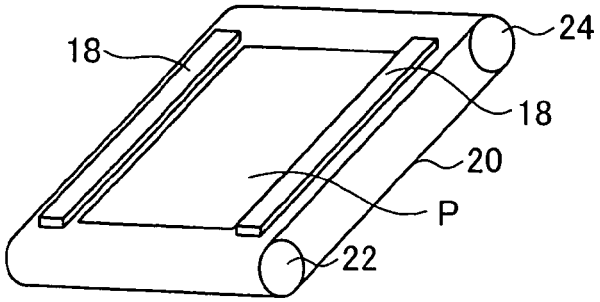

Further, in the example shown in FIG. 6C, the strong electric field formation portion 18 is provided only at one end portion of the conveyor belt 20 in the direction orthogonal to the conveying direction. However, as shown in FIG. 6D, the strong electric field formation portions 18 may be provided at both end portions of the conveyor belt 20 in the direction orthogonal to the conveying direction.

Also, the time required for the strong electric field formation portion to pass through the position opposing the ejection head is not specifically limited, and it is sufficient that the strong electric field formation portion passes through the position opposing the ejection head momentarily at least before recording so long as it is possible to place the ejection portion of the ejection head, in particular, the tip end portion of the ink guide under the ink-wet state before recording.

Here, when the time required for the strong electric field formation portion to pass through the position opposing the ejection head is set at a momentary time, that is, a short time, even when the strong electric field formation portion is charged to a potential at which ink droplets are ejected, it becomes possible to minimize the ink droplet ejection and suppress consumption of the ink.

FIGS. 7A to 7F are each a cross-sectional view schematically showing an arrangement example of the strong electric field formation portion 18.

Figure 7A:
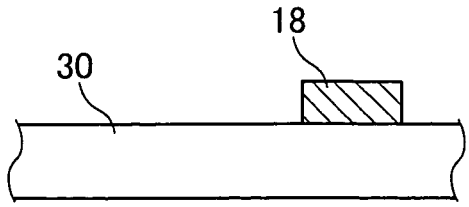
FIGS. 7A to 7F are each a cross-sectional view schematically showing an arrangement example of the strong electric field formation portion of the ink jet recording apparatus shown in FIG. 1.

In this embodiment, as shown in FIG. 7A, the strong electric field formation portion 18 is placed on the conveyor belt 20. However, the present invention is not limited to this. As shown in FIGS. 7B to 7F, a part of the insulating layer 30 of the conveyor belt 20 may be the strong electric field formation portion 18, that is, the strong electric field formation portion 18 and the insulating layer 30 may be integrated with each other.

Figure 7B:
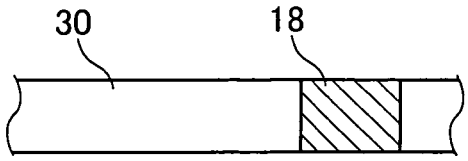
Figure 7C:
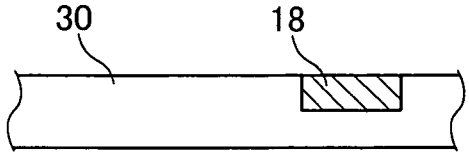
Figure 7D:
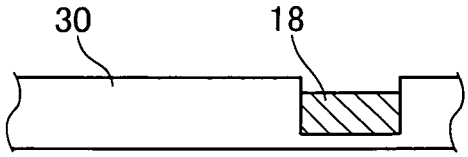

For instance, as shown in FIG. 7B, the strong electric field formation portion 18 may be provided so that a surface of the strong electric field formation portion 18 on an ejection head side is flush with a surface of the insulating layer 30 and that a surface of the strong electric field formation portion 18 on a side opposite to the ejection head 16 side contacts a conductive layer (not shown). Also, as shown in FIG. 7C, the strong electric field formation portion 18 may be provided so that the surface of the strong electric field formation portion 18 on the ejection head 16 side is flush with the surface of the insulating layer 30 and that the surface of the strong electric field formation portion 18 on the side opposite to the ejection head 16 side contacts the insulating layer 30. Further, as shown in FIG. 7D, the strong electric field formation portion 18 may be provided in a recessed manner in which the surface of the strong electric field formation portion 18 on the ejection head side is lower than the surface of the insulating layer 30, that is, the strong electric field formation portion 18 is recessed toward a conductive layer (not shown) side.

By providing the strong electric field formation portion 18 so that the surface of the strong electric field formation portion 18 is flush with or lower than the surface of the conveyor belt 20 in the manner described above, it becomes possible to prevent a foreign matter or the like adhering onto the strong electric field formation portion 18 from contacting the ejection head 16, which may break the head.

Figure 7E:
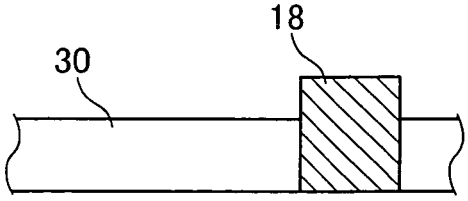
Figure 7F:
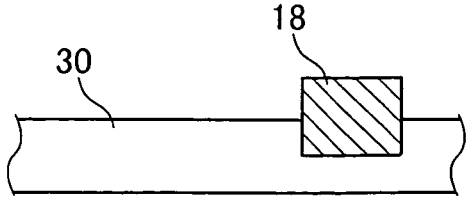

Also, even when the strong electric field formation portion 18 and the insulating layer 30 are integrated with each other, the strong electric field formation portion 18 may be provided in a projection manner like in the case of FIG. 7A. That is, as shown in FIG. 7E, the strong electric field formation portion 18; may be provided so that the surface of the strong electric field formation portion 18 on the ejection head 16 side is projected toward the ejection head 16 side with respect to the surface of the insulating layer 30 and that the surface on the side opposite to the ejection head 16 side contacts a conductive layer (not shown). Alternatively, as shown in FIG. 7F, the strong electric field formation portion 18 may be provided so that the surface of the strong electric field formation portion 18 on the ejection head 16 side is projected toward the ejection head 16 side with respect to the surface of the insulating layer 30 and that the surface on the side opposite to the ejection head 16 side contacts the insulating layer 30. That is, the strong electric field formation portion 18 may be a projection portion having a shape that is projected toward the ejection head 16 side with respect to the surface of the insulating layer 30.

Here, in the embodiment described above, as the strong electric field formation portion, a member, whose insulation property is higher than that of the insulating layer of the conveyor belt, is used. However, the present invention is not limited to this. That is, even when a member which is the same as that used for the insulating layer 30, or a member, whose intrinsic volume resistance is somewhat lower than that of the insulating layer 30, is used as the strong electric field formation portion 18, by forming the strong electric field formation portion 18 in the shape, as shown in FIGS. 7A, 7E, and 7F, which is projected toward the ejection head 16 side with respect to the surface of the conveyor belt 20 (insulating layer 30 thereof), a gap between the ejection head 16 and the strong electric field formation portion 18 at the time of passage through the position opposing the ejection head 16 is reduced, making it possible to form an electric field, which is stronger than those at the time of passage of the conveyor belt 20 and in the case where the recording medium P opposes the ejection head 16, in the ejection portion.

Here, in this embodiment, the charge means applies a voltage, which is the same as that of the recording medium, to the strong electric field formation portion as a constant grid voltage without controlling the applied voltage. However, the first embodiment of the present invention is not limited to this. The strong electric field formation portion may be charged to a higher potential by applying a higher voltage to the strong electric field formation portion with the charge means while controlling the charge means. By providing a control portion and charging the strong electric field formation portion to a higher potential in this manner, it becomes possible to form a stronger electric field at the time of passage of the strong electric field formation portion through the position opposing the ejection head. As a result, it becomes possible to place the tip end portion of the ink guide under the wet state with more reliability and perform image recording more stably.

Also, when the voltage applied by the charge means is not controlled, the necessity to provide the control portion is eliminated, so it becomes possible to simplify the apparatus construction.

Hereinafter, an operation of the recording apparatus 10 will be described.

In the recording apparatus 10, the recording medium P is supplied from a sheet feed tray (not shown) to the conveyor belt 20 at the time of image recording. Here, the recording medium P is placed so that the strong electric field formation portion 18 is arranged on the downstream side in the conveying direction.

The conveyor belt 20 on which the recording medium P is placed at a predetermined position is moved in a predetermined direction by the belt rollers 22, 24. In synchronization with the movement of the conveyor belt 20, the strong electric field formation portion 18 provided on the conveyor belt 20 and the recording medium P placed on the conveyor belt 20 are also conveyed in the predetermined direction.

The strong electric field formation portion 18 and the recording medium P conveyed by the conveyor belt 20 pass through the position opposing the charge means 14 in this order.

The strong electric field formation portion 18 and the recording medium P having passed through the position opposing the charge means 14 are each charged to a predetermined potential. Here, the strong electric field formation portion 18 is charged to a potential that is higher than those of the recording medium P and the insulating layer 30 of the conveyor belt 20, and the recording medium P is electrostatically attracted to the conveyor belt 20.

The strong electric field formation portion 18 and the recording medium P charged by the charge means 14 are moved to the position opposing the ejection head 16 in this order.

When the strong electric field formation portion 18 passes through the position opposing the ejection head 16, an electric field that is higher than those at the time of passage of the conveyor belt 20 and at the time of passage of the recording medium P is formed around the ejection portion of the ejection head 16. As a result, the tip end portion 74*a* of every ink guide 74 of the ejection head 16 is placed under the ink-wet state.

Following this, the recording medium P is conveyed to the position opposing the ejection head 16, and an image is formed by the ejection of the ink from the ejection head 16 corresponding to image data on a surface of the recording medium P that is conveyed at a predetermined constant speed along with the movement of the conveyor belt 20.

The recording medium P on which the image has been formed is conveyed to a fixing device (not shown) by which the image is fixed onto the recording medium P. The recording medium P on which the image has been fixed is discharged onto a discharge tray (not shown).

Here, in this embodiment, the conveyor belt 20, which has a two-layer structure including the insulating layer 30 and the conductive layer 32 and has a construction in which the potential of the conductive layer 32 is held at a reference potential of 0V through contact of the conductive layer 32 with the grounded belt roller 22, is used. However, the present invention is not limited to this. For instance, as shown in FIG. 8, a conveyor belt 60 may be constructed using an insulation member, a flat-plate-shaped conductive platen 62 may be arranged inside the conveyor belt 60, that is, on the belt rollers 22, 24 side at a position opposing the ejection head 16 so that it contacts the conveyor belt 60, and an inner portion of the conveyor belt 60 opposing the ejection head 16 may be held at the reference potential of 0V by grounding the conductive platen 62.

Also in the case of the conveyor belt 60, by providing the strong electric field formation portion 18 on the conveyor belt 60 on the downstream side in the conveying direction with respect to the attached position of the recording medium, it becomes possible to achieve the above-mentioned effects of the present invention.

It is possible to form the conveyor belt 60 using a material that is the same as that of the insulating layer 30 of the conveyor belt 20 described above such as a polyimide resin or a fluo-o resin. Herein, examples of the fluoro resin include polytetrafluoroethylene (PTFE), tetrafluoroethylene-perfluoroalkoxyethylene copolymer (PFA), tetrafluoroethylene-hexafluoropropylene copolymer (FEP), tetrafluoroethylene-ethylene copolymer (ETFE), polychlorotrifluoroethylene (PCTFE), chlorotrifluoroethylene-ethylene copolymer (ECTFE), polyvinylidene fluoride (PVDF), and polyvinyl fluoride (PVF).

Figure 8:
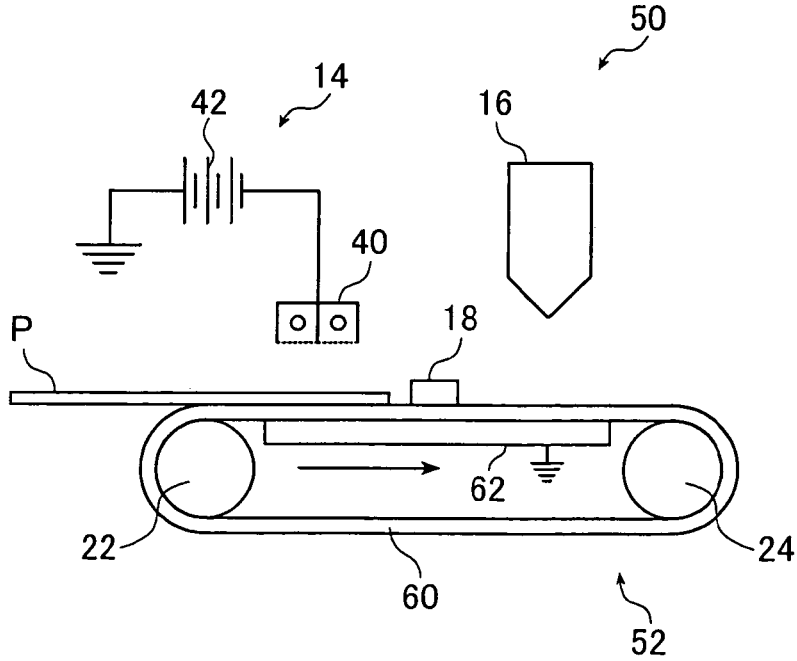
FIG. 8 is a schematic front view showing an outlined construction of another embodiment of an ink jet recording apparatus according to the present invention.

Here, when the conveyor belt 60 is formed using only an insulation member as shown in FIG. 8, it becomes possible to uniformly attract and convey the recording medium P by setting the surface roughness Ra at 5 μm or less or preferably at 2 μm or less. Also, it becomes possible to obtain sufficient durability and belt conveying suitability by setting the thickness of the conveyor belt 60 at 10 to 500 μm or preferably at 50 to 300 μm. Further, it becomes possible to obtain high conveying accuracy and high durability by setting the tensile strength of the conveyor belt 60 at 100 $kg/cm^2$ or more or preferably at 120 $kg/cm^2$ or more. Still further, it becomes possible to secure favorable charge (charging potential) retentivity by setting the volume resistivity of the conveyor belt 60 at $10^{14}$ Ω·cm or more or preferably at $10^{15}$ Ω·cm or more. Yet further, it becomes possible to stabilize the conveying accuracy with respect to humidity variations by setting the water absorption (measured in accordance with ASTMD 570) of the conveyor belt at 5% or less or preferably at 2% or less.

Here, in this embodiment, a bias voltage is applied by charging the recording medium P through application of a predetermined voltage to the recording medium P. However, the present invention is not limited to this. The bias voltage may be applied by applying a predetermined voltage to the conductive layer of the conveyor belt or the conductive platen.

Next, a specific example of an ink jet recording apparatus of the first embodiment in the present invention will be explained referring to FIGS. 9A and 9B.

Figure 9A:
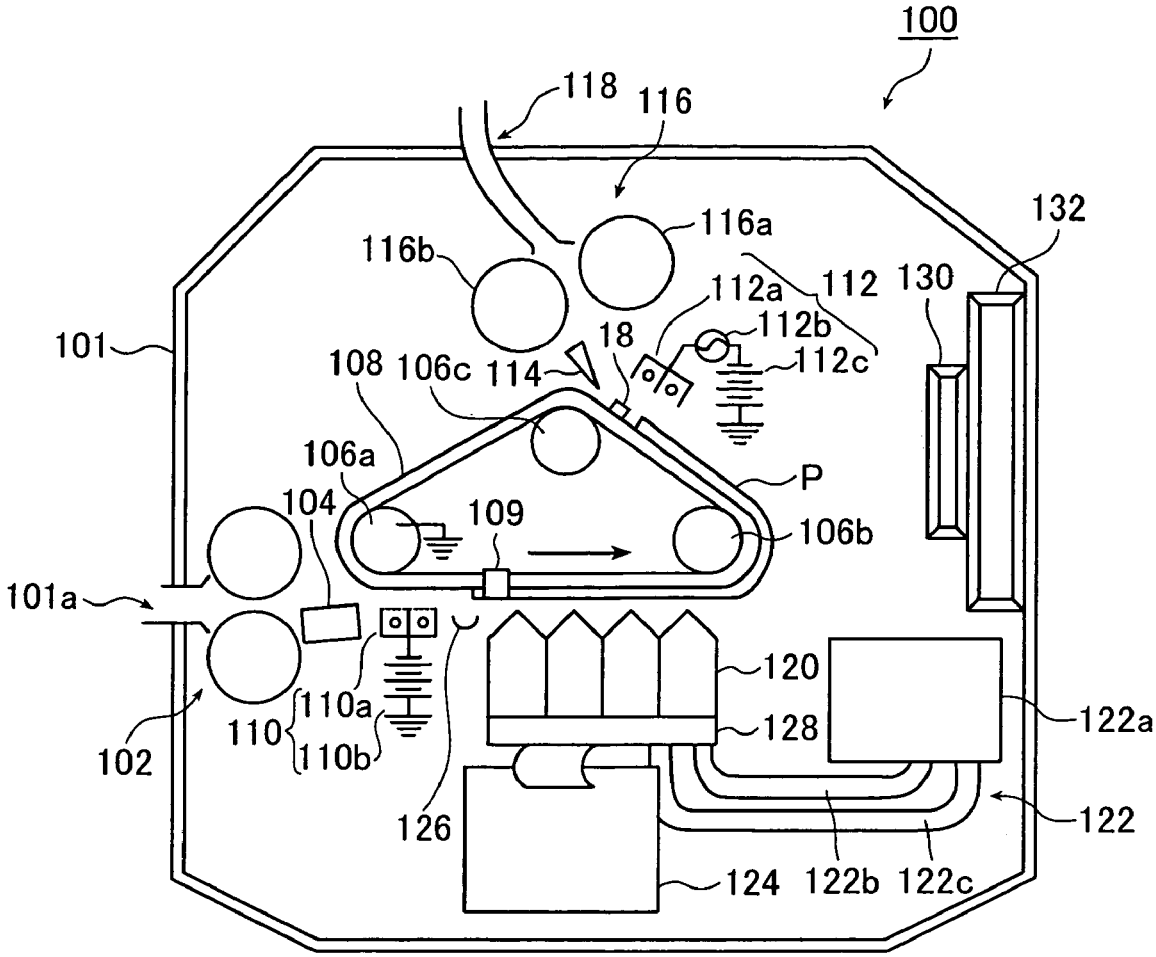
FIG. 9A is a front view conceptually showing a specific example of the ink jet recording apparatus according to the present invention.
Figure 9B:
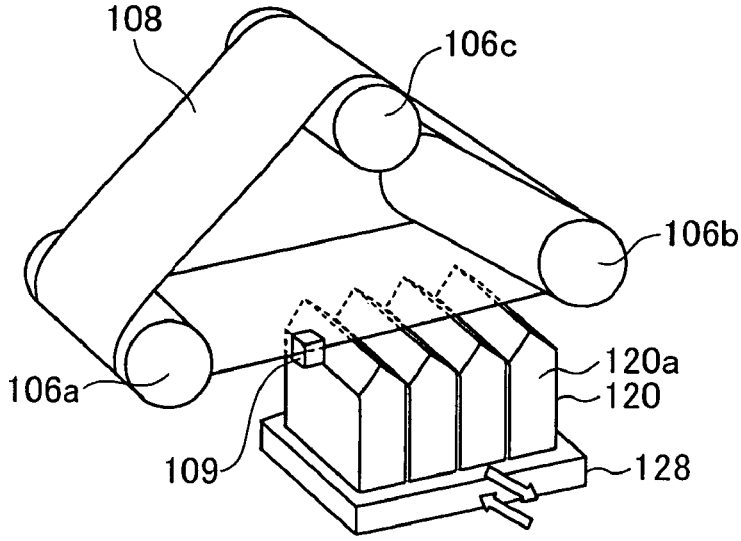
FIG. 9B is a perspective view partially showing a periphery of a head unit of the ink jet recording apparatus shown in FIG. 9A.

FIG. 9A is a schematic front view schematically showing a whole configuration of one specific example of an electrostatic ink jet recording apparatus of the first embodiment in the present invention, and FIG. 9B is a perspective view showing a head unit and a conveying system of the example shown in FIG. 9A.

An ink jet recording apparatus 100 (hereinafter, referred to as an ink jet printer 100) shown in FIG. 9A is an apparatus for performing four-color one-side printing on the recording medium P. The ink jet printer 100 includes conveying means for the recording medium P, image forming means, and solvent collecting means, all of which are accommodated in a casing 101. The conveying means includes a feed roller pair 102, a guide 104, rollers 106*a*, 106*b* and 106*c*, a conveyor belt 108, conveyor belt position detecting means 109, charge means 110, static elimination means 112, separation means 114, fixation/conveyance means 116, and a guide 118. The image forming means includes a head unit 120, an ink circulating system 122, a head driver 124, recording medium position detecting means 126 and recording position controlling means 128. The solvent collecting means includes a discharge fan 130 and a solvent collecting device 132.

The strong electric field formation portion 18 which is a characteristic site in the present invention is provided on the conveyor belt 108.

First, the conveying means for a recording medium P in the ink jet printer 100 will be explained.

The feed roller pair 102 is composed of a pair of rollers, and is disposed in the vicinity of a feeding port 101*a* provided in a side surface of the casing 101. The feed roller pair 102 feeds the recording medium P fed from a paper cassette (not shown) to the conveyor belt 108 (a portion supported by the roller 106*a*) in the casing 101. The guide 104 is disposed between the feed roller pair 102 and the roller 106*a* for supporting the conveyor belt 108 and guides the recording medium P fed by the feed roller pair 102 to the conveyor belt 108.

Foreign matter removal means for removing foreign matter such as dust or paper powder adhered to the recording medium P is preferably disposed in the vicinity of the feed roller pair 102. As the foreign matter removal means, one or more of known methods including non-contact removal methods such as suction removal, blowing removal and electrostatic removal, and contact removal methods such as removal using a blush, a roller, etc., may be used in combination. It is also possible that the feed roller pair 102 is composed of a slightly adhesive roller, a cleaner is prepared for the feed roller pair 102, and foreign matter such as dust or paper powder is removed when the feed roller pair 102 feeds the recording medium P.

The conveyor belt 108 is stretched around the three rollers 106*a*, 106*b* and 106*c* to be moved. At least one of the rollers 106*a*, 106*b* and 106*c* is connected to a drive source (not shown).

At the time that an image is formed by ink ejected from the ejection head 120*a* of the head unit 120, the conveyor belt 108 functions as a platen for holding the recording medium P, and moves the recording medium P. Also, after image formation, the conveyor belt 108 conveys the recording medium P to the fixation/conveyance means 116. Therefore, the conveyor belt 108 is an endless belt made of a material which is excellent in dimension stability and has durability.

In the illustrated embodiment, the recording medium P is held on the conveyor belt 108 under electrostatic attraction. In correspondence with this, the conveyor belt 108 has insulating properties on a side on which the recording medium P is held (front face), and conductive properties on the other side on which the conveyor belt 108 contacts the rollers 106*a*, 106*b* and 106*c* (rear face). Specifically, the conveying belt 108 is a metal belt with its front face coated with fluoro resin. In the illustrated embodiment, the roller 106*a* is a conductive roller, and the rear face (metal face) of the conveying belt 108 is grounded via the roller 106*a*.

The strong electric field formation portion 18 is placed on the downstream side in the conveying direction with respect to the attached position of the recording medium P to the conveyor belt 20.

Meandering of the conveyor belt 108 is preferably suppressed by a known method. An example of a meandering suppression method is that the roller 106*c* is composed of a tension roller, a shaft of the roller 106*c* is inclined with respect to shafts of the rollers 106*a* and 106*b* in response to an output of the conveyor belt position detecting means 109, that is, a position of the conveyor belt 108 detected in a width direction, thereby changing a tension at both ends of the conveyor belt in the width direction to suppress the meandering. The rollers 106*a*, 106*b* and 106*c* may have a taper shape, a crown shape, or another shape to suppress the meandering.

The conveyor belt position detecting means 109 suppresses the meandering of the conveyor belt etc. in the above manner and detects the position of the conveyor belt 108 in the width direction to regulate the recording medium P to situate at a predetermined position in an auxiliary scanning direction at the time of image recording. Known detecting means such as a photo sensor may be used.

The charge means 110 charges the recording medium P to a predetermined bias voltage with respect to the head unit 120 (ejection head 120*a*), charges the recording medium P to have a predetermined potential so that the recording medium P is electrostatically attracted to and held on the conveyor belt 108 under electrostatic force, and further charges the strong electric field formation portion 18 to a predetermined potential.

In the illustrated embodiment, the charge means 110 includes a scorotron charger 110*a* for charging the recording medium P and a negative high voltage power source 110*b* connected to the scorotron charger 110*a*. The recording medium P is charged to a negative high voltage by the scorotron charger 110*a* connected to the negative high voltage power source 110*b* and electrostatically attracted to the insulating layer of the conveyor belt 108.

The charge means is not limited to the scorotron charger 110*a* of the illustrated embodiment, but a corotron charger, a solid-state charger, an electrostatic discharge needle and various means and methods can be employed. As will be described in detail later, at least one of the rollers 106*a*, 106*b* and 106*c* is composed of a conductive roller, or a conductive platen is disposed on the rear side of the conveyor belt 108 in a recording position for the recording medium P (side opposite to the recording medium P). Then, the conductive roller or the conductive platen is connected to the negative high voltage power source, thereby forming the charge means 110. Alternatively, it is also possible that the conveyor belt 108 is composed of an insulating belt, the conductive roller is grounded, and the conductive platen is connected to the negative high voltage power source.

The charge means 110 makes a recording medium P electrostatically attracted to the conveyor belt 108 by means of electrostatic force in a state where the recording medium P is placed on the conveyor belt 108 without the presence of any air therebetween and thereafter, uniformly charges the surface of the recording medium P while the conveyor belt 108 is being driven. Note that the conveying speed of the conveyor belt 108 when charging the recording medium P may be in a range where the charging is performed with stability, so the speed may be the same as, or different from, the conveying speed at the time of image recording. Also, the charge means may act on the same recording medium P several times by circulating the recording medium P several times on the conveyor belt 108 for uniform charging.

In this embodiment, the electrostatic attraction and the charging for the recording medium P are performed by the charge means 110, but the electrostatic attraction and the charging for the recording medium P may be performed by different charge means.

The conveyor belt 108 conveys the recording medium P and the strong electric field formation portion 18 charged by the charge means 110 to the position where the head unit 120 to be described later is located. As described above, the strong electric field formation portion 18 is positioned on the downstream side of an attached position of the recording medium P in the conveying direction. Therefore, the strong electric field formation portion 18 passes through the position opposing the head unit 120 before the recording medium P is conveyed to the position opposing the head unit 120, thereby making all the ejection portions be in wet state.

The head unit 120 uses the above ejection head shown in FIGS. 2A to 5B to record an image on the recording medium P. As described above, the ejection head uses a charge potential of the recording medium P for the bias voltage, and a drive voltage is applied to the ejection electrodes of the ejection head, whereby the drive voltage is superposed on the bias voltage and the ink droplets R are ejected to record an image on the recording medium P. At this time, the conveyor belt 108 is provided with heating means to increase the temperature of the recording medium P, thus promoting fixation of the ink droplets R on the recording medium P and further suppressing ink bleeding, which leads to improvement in image quality. Image recording using the head unit 120 and the like will be described in detail below.

The recording medium P on which the image is formed is subjected to electrostatic elimination by the electrostatic elimination means 112, separated from the conveyor belt 108 by the separation means 114 and thereafter, conveyed to the fixation/conveyance means 116.

In this embodiment, the electrostatic elimination means 112 includes a corotron charger 112*a*, an AC power source 112*b*, and a DC high voltage power source 112*c* with one end grounded. In the illustrated embodiment, the electrostatic elimination means 112 is a so-called AC corotron charger in which the corotron charger 112*a* and the AC power source 112*b* are used. In addition thereto, various means and methods, for example, a scorotron charger, a solid-state charger, and an electrostatic discharge needle can be used. Also, as in the charge means 110 described above, a structure using a conductive roller or a conductive platen can also be preferably utilized. A known technique using a separation blade, a counter-rotating roller, an air knife or the like is applicable to the separation means 114.

The recording medium P separated from the conveyor belt 108 is sent to the fixation/conveyance means 116 where the image formed by means of the ink jet recording is fixed. A pair of rollers composed of a heat roller 116*a* and a conveying roller 116*b* is used as the fixation/conveyance means 116 to contact-heat and fix the image formed on the recording medium P while conveying the recording medium P. In the present invention, fixing means may be provided separately from conveying means composed of the conveying roller pair, and a recorded image may be fixed with the fixing means or by other fixing methods.

In addition to the heat roll fixation described above, examples of the heat fixation means include irradiation with infrared rays or using a halogen lamp or a xenon flash lamp, and general heat fixation such as hot air fixation using a heater.

It should be noted that in the case of heat fixation, when a sheet of coated paper or laminated paper is used as the recording medium P, there is a possibility of causing a phenomenon called "blister" in which irregularities are formed on the sheet surface since moisture inside the sheet abruptly evaporates due to rapid temperature increase. To avoid this, it is preferable that a plurality of fixing devices be arranged, and at least one of power supply to the respective fixing devices and a distance from the respective fixing devices to the recording medium P be changed such that the temperature of the recording medium P gradually increases.

It is preferable that no components contact the image forming surface of the recording medium P at least during a time from the image formation with the head unit 120 until the completion of fixation with the fixation/conveyance means 116.

Further, the movement speed of the recording medium P at the time of fixation with the fixation/conveyance means 116 is not particularly limited, which may be the same as, or different from, the conveying speed by the conveyor belt 108 at the time of image formation. When the movement speed is different from the conveying speed at the time of image formation, it is also preferable to provide a speed buffer for the recording medium P immediately before the fixation/conveyance means 116.

The recording medium P on which the image is fixed is guided by the guide 118 and delivered to a delivered paper tray (not shown).

Next, image forming (drawing) means and image recording method using the ink jet printer 100 will be described.

As described above, the image forming means of the ink jet printer 100 includes the head unit 120 for ejecting ink, the ink circulating system 122 that supplies the ink Q to the head unit 120 and recovers the ink Q from the head unit 120, the head driver 124 that drives the head unit 120 based on an output image signal from a not-shown external apparatus such as a computer or a raster image processor (RIP), the recording medium position detecting means 126 for detecting the recording medium P in order to determines an image forming (recording) position on the recording medium P, and the recording position controlling means 128 for controlling the position of the head unit 120.

FIG. 9B is a schematic perspective view showing the head unit 120 and the recording position controlling means 128, and also showing the conveying means for the recording medium P on the periphery thereof.

The head unit 120 includes four ejection heads 120*a* for four colors of cyan (C), magenta (M), yellow (Y), and black (K) for recording a full-color image, and forms (records) an image on the recording medium P conveyed by the conveyor belt 108 at a predetermined speed by ejecting the ink supplied by the ink circulating system 122 as ink droplets in accordance with signals from the head driver 124. The ejection heads for the respective colors are arranged along a conveying direction of the conveyor belt 108. Note that the ejection head 120*a* for each color in the head unit 120 is the above ink jet head shown in FIGS. 2A to 5B.

In the illustrated embodiment, each of the ejection heads 120*a* is a line head including the ejection ports 82 disposed in the entire area in the width direction of the recording medium P. The ink jet head 120*a* is preferably a multi-channel head as shown in FIG. 3, which has multiple nozzle lines arranged in a staggered shape.

Therefore, in the illustrated embodiment, while the recording medium P is held on the conveyor belt 108, the recording medium P is conveyed to pass over the head unit 120 once. In other words, scanning and conveyance are performed only once for the head unit 120. Then, an image is formed on the entire surface of the recording medium P. Therefore, image recording (drawing) at a higher speed is possible compared to serial scanning of the ejection head.

Note that the ink jet head of the present invention is also applicable to a so-called serial head (shuttle type head), and therefore the ink jet printer 100 may take this configuration.

In this case, the head unit 120 is structured such that a line (which may have a single line or multi channel structure) of the ejection ports 82 for each ink jet head agrees with the conveying direction of the conveyor belt 108, and the head unit 120 is provided with scanning means which scans the head unit 120 in a direction perpendicular to the direction in which the recording medium P is conveyed. Any known scanning means can be used for scanning.

Image recording may be performed as in a usual shuttle type ink jet printer. In accordance with the length of the line of the ejection ports 82, the recording medium P is conveyed intermittently by the conveyor belt 108, and in synchronization with this intermittent conveying, the head unit 120 is scanned when the recording medium is at rest, whereby an image is formed on the entire surface of the recording medium P.

As described above, the image formed by the head unit 120 on the entire surface of the recording medium P is then fixed by the fixation/conveyance means 116 while the recording medium P is nipped and conveyed by the fixation/conveyance means 116.

The ink circulating system 122 allows each ink Q sufficient for ink ejection to flow in the ink flow path 84 (see FIG. 2A) of the corresponding ejection head 120*a* of the head unit 120. For each of the ink of the four colors (C, M, Y, K), the ink circulating system 122 includes: an ink circulating device 122*a* having ink tanks for respective four colors, a pump, a replenishment ink tank (not shown), etc.; an ink supply system 122*b* for supplying the ink Q of each color from the ink tank of the ink circulating device 122*a* to the ink flow path 84 (refer to FIG. 2A) of each ejection head 120*a* of the head unit 120 (from the left side in FIG. 2A); and an ink recovery system 122*c* for recovering the ink Q from the ink flow path 84 of each ejection head 120*a* of the head unit 120 (from the right side in FIG. 2A) into the ink circulating device 122*a*. The ink supply system 122*b* includes ink supply path composed of ink supply lines for respective colors, and the ink recovery system 122*c* includes ink recovery path composed of ink recovery lines for respective colors.

An arbitrary system may be used for the ink circulating system 122 as long as this system supplies the ink Q of a color corresponding to each ejection head 120*a* from the ink tank to the head unit 120 through the ink supply system 122*b* and recovers the ink from the head unit 120 to the ink tank through the ink recovery system 122*c* to allow ink circulation in a path for returning the ink into the corresponding ink tank. Each ink tank contains the ink Q of the corresponding color for image recording and the ink Q is supplied to the head unit 120 by means of a pump. Ejection of the ink from the head unit 120 lowers the concentration of ink circulating in the ink circulating system 122. Therefore, it is preferable in the ink circulating system 122 that the ink concentration be detected by an ink concentration detecting device and the ink tank be replenished as appropriate with ink from the replenishment ink tank to keep the ink concentration in a predetermined range.

Moreover, the ink tank is preferably provided with an agitator for suppressing precipitation/aggregation of solid components of the ink and an ink temperature control device for suppressing ink temperature change. The reason thereof is as follows. If the temperature control is not performed, the ink temperature changes due to ambient temperature change or the like. Thus, physical properties of the ink are changed, which causes the dot diameter change. As a result, a high quality image may not be recorded in a consistent manner.

A rotary blade, an ultrasonic transducer, a circulation pump, or the like may be used for the agitator.

Any known ink temperature control unit can be used for an ink temperature control apparatus, as exemplified by a unit in which a temperature controlling element or temperature controlling means which includes at least one of a heating element or heating means (e.g., heater), a heating/heat absorbing element (e.g., Peltier element) and cooling means (e.g., cooler), are provided in the head unit 120, the ink tank, an ink supply line or the like together with a controller and a temperature sensor thereof, and the temperature controlling element or temperature controlling means is controlled by the controller in accordance with the ink concentration detected by the temperature sensor. Alternatively, the temperature controlling element or temperature controlling means is controlled by, for example, a thermostat in which the temperature sensor and the controller are integrated with each other. When arranged inside the ink tank, the temperature control device is preferably arranged with the agitator such that temperature distribution is kept constant. The agitator for keeping the concentration distribution in the tank constant may double as the agitator for suppressing the precipitation/aggregation of solid components of the ink.

The head driver 124 receives image data from a system control unit (not shown) that receives image data from an external apparatus and performs various processing on the image data, and drives the head unit 120 based on the image data. The system control unit color-separates the image data received from the external apparatus such as a computer, an RIP, an image scanner, a magnetic disk apparatus, or an image data transmission apparatus. The system control unit then performs division computation into an appropriate number of pixels and an appropriate number of gradations depending upon the color-separated data, and performs screening and computation of dot percent to prepare head drive data corresponding to image data with which the head driver 124 can drive the head unit 120 (ejection head 120*a*).

Also, the system control unit controls the movement of the head unit 120 (recording position controlling means 128) and timings of ink ejection by the head unit 120 in accordance with conveyance timings of the recording medium P by the conveyor belt 108. The ejection timings are controlled using an output from the recording medium position detecting means 126 or an output signal from an encoder or a photointerpreter arranged for the conveyor belt 108 or a drive means of the conveyor belt 108.

The recording medium position detecting means 126 detects the recording medium P being conveyed to a position at which an ink droplet is ejected onto the medium P from the head unit 120, and known detecting means such as photo sensor can be used.

The recording position controlling means 128 moves the head unit 120, which is placed and fixed thereto, in the width direction of the conveying belt 108 to thereby adjust an image forming position in the width direction of the recording medium P. That is, the recording position controlling means 128 moves the head unit 120 in accordance with the position of the conveyor belt 108 detected by the conveyor belt position detecting means 109 and the image signal from the head driver 124 for fine adjustment to form an image at a predetermined position on the recording medium P and for auxiliary scanning in a case of using a multi-channel head as the head unit 120.

Next, the solvent collecting means in the ink jet printer 100 will be explained.

As described above, the ink jet printer 100 includes the discharge fan 130 and the solvent collecting device 132 as the solvent collecting means. The solvent collecting means collects a dispersion solvent (carrier liquid) evaporated from the ink droplets which contain colorant particles and the dispersion solvent for dispersing colorant particles and are ejected on the recording medium P from the head unit 120, in particular, the dispersion solvent evaporated from the recording medium P at the time of fixing the image formed of the ink droplets.

The discharge fan 130 sucks air inside the casing 101 of the ink jet printer 100 to blow the air to the solvent collecting device 132.

The solvent collecting device 132 is provided with a solvent vapor absorber. This solvent vapor absorber absorbs solvent components of gas containing solvent vapor sucked by the discharge fan 130, and exhausts the gas whose solvent has been absorbed and collected, to the outside of the casing 101 of the ink jet printer 100. Various active carbons are preferably used as the solvent vapor absorber.

While the electrostatic ink jet recording apparatus for recording a color image using the ink of four colors including C, M, Y, and K has been described above, the present invention should not be construed restrictively; the apparatus may be a recording apparatus for a monochrome image or an apparatus for recording an image using an arbitrary number of other colors such as pale color ink and special color ink, for example. In such a case, the head units 120 and the ink circulating systems 122 whose number corresponds to the number of ink colors are used.

Furthermore, in the above embodiments, the ink jet recording apparatus has been described, in which ink jet image recording is performed so that the ink droplets R are ejected by positively charging the colorant particles in the ink and charging the recording medium P, the conductive platen on the rear side of the recording medium P or the conductive layer of the conveyor belt to the negative high voltage. However, the present invention is not limited to this. That is, the ink jet image recording may be performed by negatively charging the colorant particles in the ink and charging the recording medium, the conductive platen or the conductive layer of the conveyor belt to the positive high voltage. When the charged color particles have the polarity opposite to that in the above-mentioned embodiment, it is sufficient that the applied voltage to the charge means, the conductive platen, the conductive layer of the conveyor belt, the ejection electrode of the electrostatic ink jet head or the like is changed to have the polarity opposite to that in the above-mentioned embodiment.

Next, an ink jet recording apparatus according to a second embodiment of the present invention will be described in detail on the basis of the preferred embodiments shown in the accompanying drawings.

Figure 10:
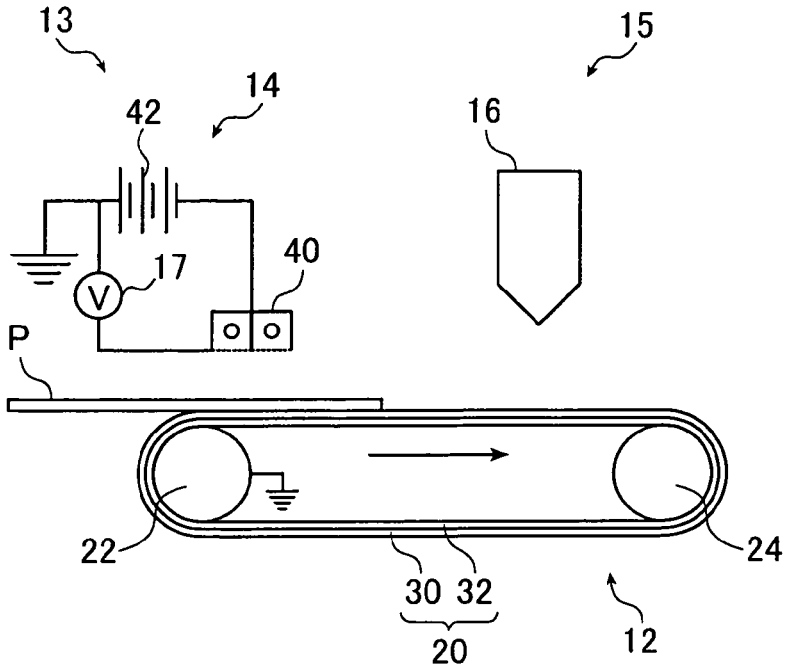
FIG. 10 is a schematic front view showing an outlined construction of still another embodiment of an ink jet recording apparatus according to the present invention.

FIG. 10 conceptually shows a case of the ink jet recording apparatus according to the second embodiment that implements the ink jet recording method according to the second aspect of the present invention.

An ink jet recording apparatus 15 (hereinafter referred to as the "recording apparatus 15") shown in FIG. 10 is a recording apparatus that records an image on a recording medium P in the same manner as the recording apparatus 10 shown in FIG. 1, and basically includes the conveyor means 12 for conveying the recording medium P through a predetermined path including the movable conveyor belt 20 the surface of which the recording medium P is attached to and the belt rollers 22, 24 for driving the conveyor belt 20, strong electric field generation means 13 including: the charge means 14 for charging at least one of the recording medium P and the conveyor belt 20 to a predetermined potential; and a voltage control portion 17 for controlling a voltage applied to the charge means 14, and the ejection head (ink jet head) 16 for ejecting ink droplets by exerting electrostatic force onto ink.

It should be noted that FIG. 10 mainly shows characteristic sites of the second embodiment of the present invention, however, in addition to the conveyor means 12, the strong electric field generation means 13, and the ejection head 16 shown in FIG. 10, the recording apparatus 15 in the second embodiment of the present invention of course includes various construction elements provided in known electrostatic ink jet recording apparatuses such as a driver for driving the ejection head 16 to eject the ink droplets, electrostatic elimination means for performing electrostatic elimination to the recording medium P and the conveyor belt 20 which are charged, circulation means for performing supply of the ink to the ejection head 16, recovery of the ink used in the ejection head 16 and the like, a sensor for detecting the conveyed recording medium P, and solvent collecting means for collecting a carrier liquid remaining in the apparatus and the like.

It should be noted that the recording apparatus 15 shown in FIG. 10 has approximately the same construction as the recording apparatus 10 shown in FIG. 1, so like reference numerals denote like elements and the detailed description thereof will be omitted. The following description will be centered on points unique to the recording apparatus 15.

In this second embodiment, it is preferable that the intrinsic volume resistivity of the insulating layer 30 of the conveyor belt 20 be set at $10^{14}$ Ω·cm or more and that the intrinsic surface resistance thereof be set at $10^{15}$Ω or more. By setting the intrinsic resistance value and the intrinsic surface resistance value in the ranges described above, the surface of the conveyor belt assumes high insulation property, making it possible to locally change a charging potential charged by the charge means 14 to be described later.

The strong electric field generation means 13 includes: the charge means 14 for charging the recording medium P and the insulating layer 30 of the conveyor belt 20 to a predetermined potential; and the voltage control portion 17 for controlling a voltage applied to the charge means 14.

The charge means 14 is arranged to oppose a surface of the conveyor belt 20 on the insulating layer 30 side, that is, a surface on which the recording medium P is placed, and includes the scorotron charger 40 and the high voltage power supply 42. The scorotron charger 40 is arranged at a position opposing the surface of the conveyor belt 20 on the insulating layer 30 side. Further, the scorotron charger 40 is connected to a negative-side terminal of the high voltage power supply 42 and a positive-side terminal of the high voltage power supply 42 is grounded.

The charge means 14 charges the recording medium P and/or a surface of the insulating layer 30 of the conveyor belt 20 to a predetermined potential (negative high potential in this embodiment) with the scorotron charger 40 connected to the high voltage power supply 42. Here, as described above, the potential of the conductive layer 32 of the conveyor belt 20 is held at the reference potential. As a result, the potential, to which the recording medium P and the insulating layer 30 are charged, is stabilized.

In this embodiment, the scorotron charger is used as the charge means, however, the present invention is not limited thereto. Various means such as a corotron charger, a solid-state charger, and an electrostatic discharge needle can be employed.

The voltage control portion 17 is connected to the scorotron charger 40 and controls a grid voltage of the scorotron charger 40. In the present invention, the grid voltage is controlled by the voltage control portion 17 so that the voltage, to which the recording medium P and the conveyor belt 20 are charged, is controlled.

As to the control of the voltage to which the recording medium P and the conveyor belt 20 are charged by the strong electric field generation means 13, detailed description will be given later.

The points unique to the recording apparatus 15 in this second embodiment of the present invention have been described above. The recording apparatus in this second embodiment according to the present invention includes the strong electric field generation means 13 having a function of preventing the ejection portion of the ejection head, such as the tip end portion of the ink guide, from drying by making the ink supplied to the tip end portion of the ink guide to place the tip end portion of the ink guide under the ink-wet state through formation of a strong electric field in the ejection portion before the recording medium P is conveyed to the position opposing the ejection head and an image is formed on the recording medium P.

As described above, the strong electric field generation means 13 in this embodiment includes the charge means 14 and the voltage control portion 17. The voltage control portion 17 controls the voltage, to which the insulating layer 30 of the conveyor belt 20 is charged, by controlling the grid voltage of the scorotron charger 40 of the charge means 14.

Figure 11A:
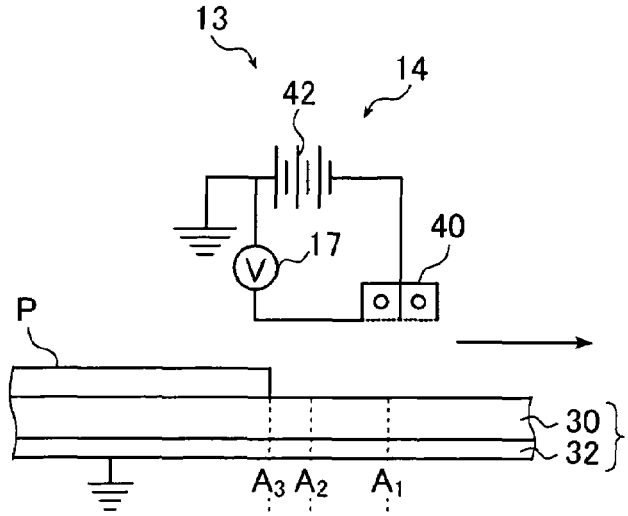
FIG. 11A is an enlarged view of the periphery of strong electric field generation means of the ink jet recording apparatus shown in FIG. 10.
Figure 11B:
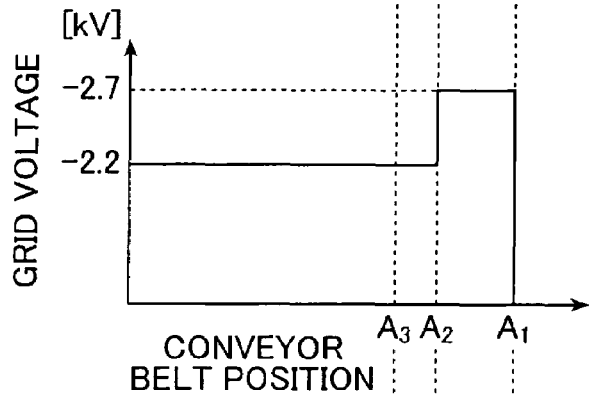
FIG. 11B is a graph showing a relation between a position on a conveyor belt shown in FIG. 11A and a grid voltage applied to a scorotron charger by a voltage control portion.
Figure 11C:
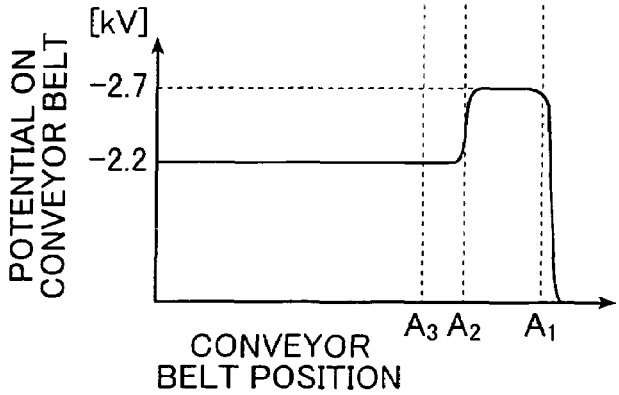
FIG. 11C is a graph showing a relation between a position on the conveyor belt shown in FIG. 11A and a potential applied to the conveyor belt (potential on conveyor belt)
Figure 11D:
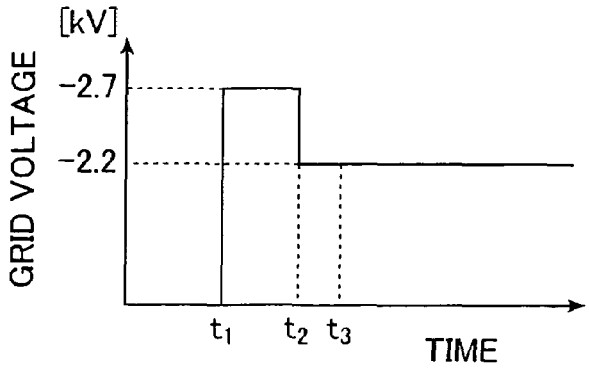
FIG. 11D is a graph showing a relation between the grid voltage applied to the scorotron charger by the voltage control portion shown in FIG. 11B and time.

Hereinafter, control of the charge means 14 by the voltage control portion 17 will be described in detail with reference to FIGS. 11A to 11D. Here, FIG. 11A is an enlarged view of the periphery of the strong electric field generation means 13, FIG. 11B is a graph showing a relation between the position on the conveyor belt 20 and the grid voltage applied to the scorotron charger 40 by the voltage control portion 17, FIG. 11C is a graph showing a relation between the position on the conveyor belt 20 and the potential to which the conveyor belt is charged (potential on conveyor belt), and FIG. 11D is a graph showing a relation between the grid voltage applied to the scorotron charger 40 by the voltage control portion 17 and time.

First, the conveyor belt 20 to which the recording medium P is attached starts movement together with the recording medium P (t=0).

When the conveyor belt 20 has moved and a predetermined position ($A_1$ in FIG. 11A) of the conveyor belt 20 on the downstream side in the conveying direction with respect to the tip end portion ($A_3$ in FIG. 11A) of the attached position of the recording medium P to the conveyor belt 20 has reached the position opposing the scorotron charger 40 ($t=t_1$), the voltage control portion 17 applies −2.7 kV to the scorotron charger 40 as the grid voltage and applies −6.5 kV thereto as a wire discharge voltage.

After that, until a predetermined position ($A_2$ in FIG. 11A) of the conveyor belt 20 between the tip end portion ($A_3$ in FIG. 11A) of the recording medium P and the start position ($A_1$ in FIG. 11A) of the grid voltage application has been moved to the position opposing the scorotron charger 40 ($t=t_2$), the grid voltage of −2.7 kV is applied to the scorotron charger 40.

Then, after the predetermined position ($A_2$ in FIG. 11A) between the tip end portion ($A_3$ in FIG. 11A) of the recording medium P and the start position ($A_1$ in FIG. 11A) of the grid voltage application has passed through the position opposing the scorotron charger 40 (after $t=t_2$), the grid voltage of −2.2 kV is applied to the scorotron charger 40.

Also when the recording medium P is passing through the position opposing the scorotron charger 40, that is, after the tip end portion ($A_3$ in FIG. 11A) of the recording medium P has passed through the position opposing the scorotron charger 40 (after $t=t_3$), the grid voltage of −2.2 kV is applied to the scorotron charger 40.

As described above, the voltage control portion 17 controls the grid voltage applied to the scorotron charger 40 in accordance with the position of the conveyor belt 20, as shown in FIG. 11B. Also, as shown in FIG. 11D, the voltage control portion 17 of the strong electric field generation means 13 applies −2.7 kV as the grid voltage between $t_1$ and $t_2$, and applies −2.2 kV after $t_2$ to the scorotron charger 40.

As a result, the recording medium P and the insulating layer 30 of the conveyor belt 20 are charged in the manner shown in FIG. 11C. That is, a portion between $A_1$ and $A_2$ of the insulating layer 30 of the conveyor belt 20 is charged to around −2.7 kV, and the conveyor belt 20 on a recording medium P side with respect to $A_2$ and the recording medium P are charged to around −2.2 kV. That is, a predetermined portion of the conveyor belt 20 on the downstream side in the conveying direction with respect to the attached position of the recording medium P is charged to a potential that is higher than those of the recording medium P and other portions of the conveyor belt 20.

Also, in this embodiment, by forming the conveyor belt using the member described above having high insulation property, as shown in FIG. 1C, the potential charged by the scorotron charger 40 is suitably held on the conveyor belt.

When the portion between $A_1$ and $A_2$ of the conveyor belt 20 (hereinafter referred to as the "strongly charged portion") has been conveyed to the position opposing the ejection head 16, an electric field that is stronger than that in the case where the recording medium P and other portions (portions other than the strongly charged portion) of the conveyor belt 20 opposes the ejection head 16 is formed between the ejection head 16 and the conveyor belt 20. That is, the strongly charged portion of the conveyor belt 20 gives an electric field, which is stronger than that formed in the ejection portion of the ejection head 16 at the time ink droplet ejection is not performed during image recording onto the recording medium P, to the ejection portion of the ejection head 16. That is, the strongly charged portion of the conveyor belt 20 forms a strong electric field in the ejection portion.

When the strongly charged portion of the conveyor belt 20 has been conveyed to the position opposing the ejection head 16 and the strong electric field has been formed between the ejection head 16 and the conveyor belt 20, the ink at the ejection port 82 of the ejection head 16 is attracted toward the conveyor belt 20 side to move to the tip end portion 74*a* of the ink guide 74 of the ejection head 16, thus making the tip end portion 74*a* of the ink guide 74 placed under the ink-wet state.

By charging the predetermined portion of the conveyor belt on the downstream side in the conveying direction with respect to the attached position of the recording medium to the high potential and making the portion charged to the high potential pass through the position opposing the ejection head immediately before recording is performed onto the recording medium, that is, immediately before the recording medium and the ejection head are relatively moved to the image recordable position, it becomes possible to place the tip end portion of the ink guide in the ejection portion of the ejection head under the ink-wet state before the image recording is performed onto the recording medium. As a result, regardless of the ejection history and ejection intervals, the wet state of the ejection portion (ink guide tip end portion) of the ejection head at the time of recording becomes constant and it becomes possible to eject ink droplets with constant ejection characteristics.

As described above, according to the second embodiment of the present invention, it becomes possible to set the wet state of the ejection portion constant, enhance drawing stability, and form a high-quality image on a recording medium with stability. Also, it becomes possible to set the ejection characteristics constant without performing control of the ejection head. As a result, it becomes possible to control ink droplet ejection with a simple driver and achieve an apparatus cost reduction.

Also, even when there exists an ejection portion that does not eject an ink droplet for a long time, each time the strongly charged portion of the conveyor belt passes through the opposing position, every ejection portion is placed under the wet state, so it becomes possible to prevent clogging or the like of the ejection port ascribable to non-ink droplet ejection for a long time from occurring.

Further, even in the case where ink droplets are ejected from the ejection head 16 when the strongly charged portion of the conveyor belt 20 passes through the position opposing the ejection head 16, no influence is exerted on an image to be recorded on the recording medium P, so the strongly charged portion of the conveyor belt 20 may be charged to a potential so that an electric field with which ink droplets are ejected is formed. Also, by causing ejection of ink droplets from the ejection head 16 when the strongly charged portion of the conveyor belt 20 passes through the position opposing the ejection head 16, it becomes possible to wet the tip end portion of the ink guide with reliability. In this case, it is preferable that a mechanism for cleaning the conveyor belt be provided.

It is preferable that a width of the strongly charged portion of the conveyor belt in the direction orthogonal to the conveying direction of the recording medium be set wider than that of the ejection head. That is, in the case of a line head as in this embodiment, it is preferable that the strongly charged portion be provided for the whole area of the conveyor belt in the width direction, that is, the direction orthogonal to the conveying direction.

By setting the width of the strongly charged portion in the direction orthogonal to the conveying direction wider than that of the ejection head in the direction orthogonal to the conveying direction, it becomes possible to generate a strong electric field in every ejection portion of the ejection head and place the ejection portion (every ink guide tip end portion) under the ink-wet state only by moving the strongly charged portion with the conveyor belt, that is, without moving the ejection head.

Also, the time, during which the strong electric field is formed in the ejection portion by the strong electric field generation means, is not specifically limited so long as it is possible to place the tip end portion of the ink guide of the ejection head under the ink-wet state before recording. That is, it is sufficient that the strong electric field is generated in the ejection head at least momentarily before recording and the tip end portion of the ink guide is placed under the wet state.

Also, by setting the time, during which the strong electric field is formed in the ejection portion by the strong electric field generation means, to be a momentary time, that is, a short time, even when the strong electric field generation means forms an electric field having a strength with which ink droplets are ejected, it becomes possible to minimize the ink droplet ejection and suppress consumption of the ink.

In addition, in this embodiment, a portion of the conveyor belt to be the strongly charged portion may be made of a material whose charging property is higher than that of the other portions of the conveyor belt.

By forming the portion to be the strongly charged portion using the material having such high charging property in this manner, even when the voltage applied to the strongly charged portion by the charge means is set lower than that in the embodiment described above, it becomes possible to charge the strongly charged portion of the conveyor belt to a potential that is higher than that of the other portions of the conveyor belt and form a strong electric field in the ejection head as in the embodiment described above.

Also, in the embodiment described above, the strongly charged portion is moved along with the conveyor belt 20 and is made to pass through the position opposing the ejection head 16, however, the present invention is not limited to this, and it is sufficient that a strong electric field is given to the ejection portion by the strong electric field formation portion 18 at the position opposing the ejection head immediately before the recording medium P and the ejection head 16 are relatively moved to the image recordable position. Therefore, the ejection head 16 may be moved.

It should be noted here that in this embodiment, the electrostatic attraction and charging of the recording medium, and the charging of the conveyor belt are performed by the same charge means, however, multiple charge means may be provided. For instance, charge means for electrostatically attracting the recording medium P and charging the recording medium P to a uniform potential, and charge means for selectively charging the strongly charged portion of the conveyor belt may be provided as different charge means.

Hereinafter, an operation of the recording apparatus 15 will be described.

In the recording apparatus 15, at the time of image recording, the recording medium P is supplied from a sheet feed tray (not shown) to the conveyor belt 20.

The conveyor belt 20 on which the recording medium P is placed at a predetermined position is moved in a predetermined direction by the belt rollers 22, 24. In synchronization with the movement of the conveyor belt 20, the recording medium P placed on the conveyor belt 20 is also conveyed in the predetermined direction.

When the conveyor belt 20 moves and the strongly charged portion (between $A_1$ and $A_2$ of FIG. 11A) of the conveyor belt 20 reaches the position opposing the scorotron charger 40 of the charge means 14, a high voltage (−2.7 kV, for instance) is applied to the scorotron charger 40 by the voltage control portion 17 as the grid voltage ($t_1$ to $t_2$ in FIG. 11D) and the strongly charged portion is charged to the high potential.

Following this (after $t_2$), a predetermined voltage (−2.2 kV, for instance) is applied to the scorotron charger 40 by the voltage control portion 17 as the grid voltage.

Following this, even after the tip end portion ($A_3$ in FIG. 11A) of the recording medium P, which is placed on the downstream side of the conveyor belt 20 in the conveying direction with respect to the strongly charged portion by a predetermined distance, has been conveyed to the position opposing the scorotron charger 40 (after $t_3$ in FIG. 11D), the predetermined voltage is applied as the grid voltage and the recording medium P is charged to the predetermined potential.

The strongly charged portion of the conveyor belt 20 charged to the high potential and the recording medium P charged to the predetermined potential by the strong electric field generation means 13 in the manner described above are moved to the position opposing the ejection head 16 in the stated order.

When the strongly charged portion of the conveyor belt 20 passes through the position opposing the ejection head 16, a strong electric field is formed in the ejection head 16 and the ejection portion of the ejection head, in particular, the tip end portion of the ink guide is placed under the ink-wet state.

Following this, the recording medium P is conveyed to the position opposing the ejection head, and then the ejection head 16 forms an image corresponding to image data on a surface of the recording medium P while the recording medium P is conveyed at a predetermined constant speed along with the movement of the conveyor belt 20.

The image which has been formed on the recording medium P is fixed onto the recording medium P by a fixing device (not shown). The recording medium P on which the image has been fixed is discharged onto a discharge tray (not shown).

Figure 12:
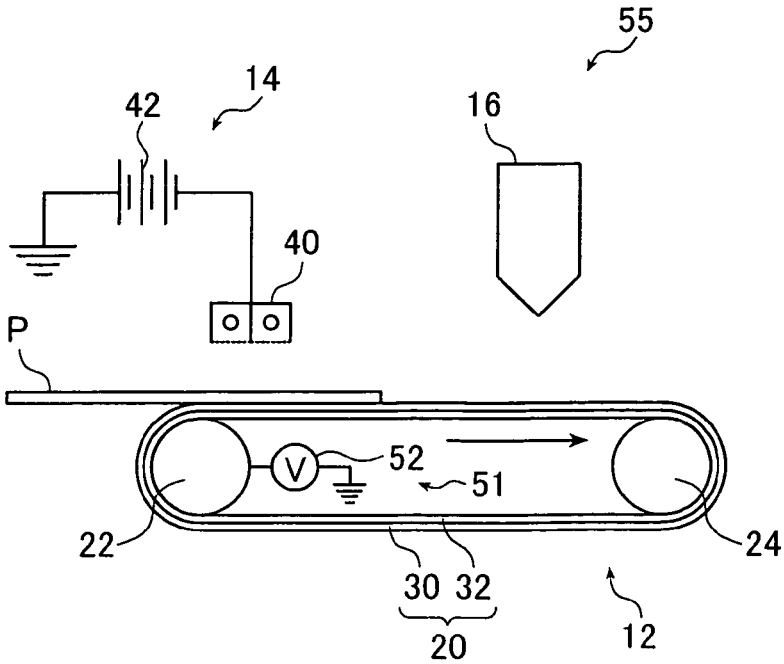
FIG. 12 is a schematic front view showing an outlined construction of still another embodiment of an ink jet recording apparatus according to the present invention.

FIG. 12 is an outlined construction diagram showing another case of the second embodiment of the present invention.

An ink jet recording apparatus 55 (hereinafter referred to as the "recording apparatus 55") shown in FIG. 12 has the same construction as the recording apparatus 15 shown in FIG. 10 except for strong electric field generation means 51. Accordingly, each same construction element is given the same reference numeral and the detailed description thereof will be omitted. Therefore, the following description will be centered on each point unique to the recording apparatus 55.

The strong electric field generation means 51 of the recording apparatus 55 includes a voltage control portion 52 for controlling an applied voltage to the belt roller 22.

The charge means 14 has the same construction as mentioned above, that is, the construction including the scorotron charger 40 and the high voltage power supply 42, and charges a recording medium P and/or a surface of the insulating layer 30 of the conveyor belt 20 to a predetermined potential (negative high potential in this embodiment). Here, in this embodiment, the charge means 14 charges the recording medium P and the insulating layer 30 of the conveyor belt 20 to a predetermined uniform potential (−2.2 kV, in this embodiment).

The voltage control portion 52 is connected to the belt roller 22, and through application of a predetermined voltage to the belt roller 22, the conductive layer 32 of the conveyor belt 20 which contacts the belt roller 22 is placed under a state where a predetermined voltage is applied. Also, the voltage control portion 52 controls the voltage applied to the conductive layer 32 and forms a strong electric field in each ejection portion of the ejection head 16.

Figure 13A:
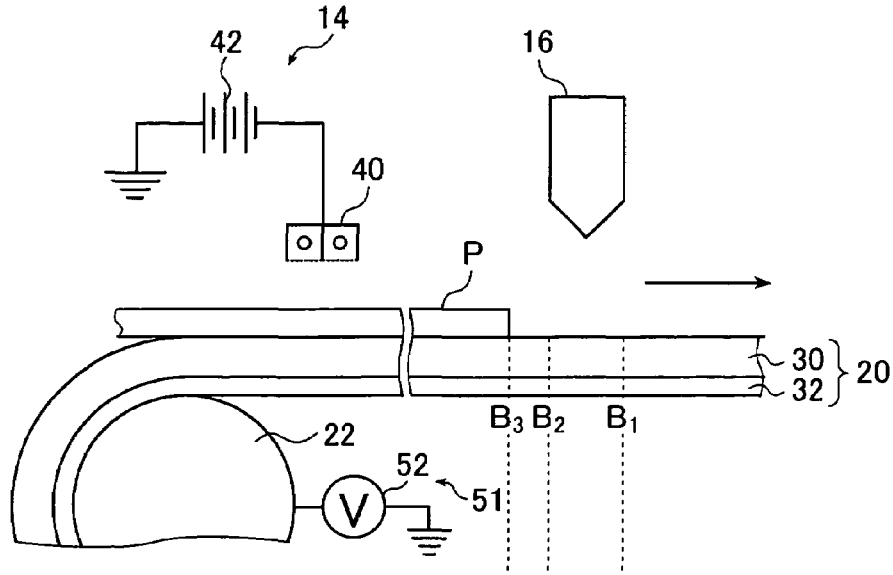
FIG. 13A is an enlarged view of the periphery of an ejection head of the ink jet recording apparatus shown in FIG. 12.
Figure 13B:
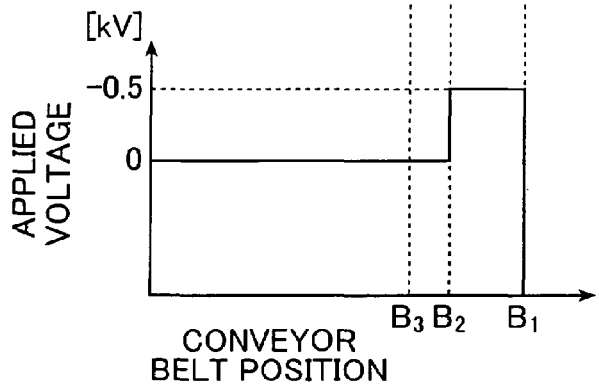
FIG. 13B is a graph showing a relation between a position of the ejection head on a conveyor belt shown in FIG. 13A and a voltage applied to a belt roller and a conductive layer by a voltage control portion.

Hereinafter, control of the voltage applied to the belt roller 22 and the conductive layer 32 of the conveyor belt 20 by the voltage control portion 52 will be described in detail with reference to FIGS. 13A and 13B. Here, FIG. 13A is an enlarged view of the periphery of the ejection head 16, and FIG. 13B is a graph showing a relation between the position on the conveyor belt 20 and the voltage applied to the belt roller 22 and the conductive layer 32 by the voltage control portion 52.

First, the conveyor belt 20 to which the recording medium P is attached starts movement together with the recording medium P. Here, in this embodiment, the conveyor belt 20 and the recording medium P are charged to a predetermined potential (−2.2 kV, in this embodiment) by the scorotron charger 40 of the charge means 14.

When a predetermined position ($B_1$ in FIG. 13A) of the conveyor belt 20 on the downstream side in a conveying direction with respect to a tip end portion ($B_3$ in FIG. 13A) of the recording medium P on the conveyor belt 20 in the conveying direction has reached a position opposing the ejection head 16, the voltage control portion 52 applies a predetermined voltage (−500 V (−0.5 kV), in this embodiment) to the belt roller 22 and the conductive layer 32.

Following this, until a predetermined position ($B_2$ in FIG. 13A) of the conveyor belt 20 between the tip end portion ($B_3$ in FIG. 13A) of the recording medium P and the start position ($B_1$ in FIG. 13A) of the voltage application has been moved to the position opposing the ejection head 16, the application of the predetermined voltage to the belt roller 22 and the conductive layer 32 is continued.

After the predetermined position ($B_2$ in FIG. 13A) between the tip end portion ($B_3$ in FIG. 13A) of the recording medium P and the start position ($B_1$ in FIG. 13A) of the voltage application has passed through the position opposing the ejection head 16, the voltage application from the voltage control portion 52 to the belt roller 22 and the conductive layer 32 is ended and the belt roller 22 and the conductive layer 32 are placed under a 0 V state.

Following this, even while the recording medium P is passing through the position opposing the ejection head 16, that is, even after the tip end portion ($B_3$ in FIG. 13A) of the recording medium P passed through the position opposing the ejection head 16, the belt roller 22 and the conductive layer 32 are placed under the 0 V state. That is, at the time of image recording onto the recording medium P, a state is obtained in which only the voltage of −2.2 kV is applied to the recording medium P by the scorotron charger 40.

As described above, the voltage control portion 52 controls the voltage applied to the belt roller 22 and the conductive layer 32 in accordance with the position of the conveyor belt.

As a result, as shown in FIG. 13B, while the portion between $B_1$ and $B_2$ on the conveyor belt 20 is passing through the position opposing the ejection head 16, the predetermined voltage is applied by the voltage control portion 52, and an electric field that is stronger than that in the case where the recording medium P and other portions (portions other than a strongly charged portion) of the conveyor belt 20 oppose the ejection head 16 is formed between the ejection head 16 and the conveyor belt 20, that is, a strong electric field is formed in the ejection portion of the ejection head 16.

Even by charging the recording medium P and the insulating layer 30 of the conveyor belt 20 to the predetermined uniform potential, and applying the predetermined voltage to the belt roller 22 and the conductive layer 32 with the voltage control portion 52 while the predetermined portion of the conveyor belt 20 on the downstream side in the conveying direction with respect to the attached position of the recording medium P to the conveyor belt 20 is passing through the position opposing the ejection head 16 as in this embodiment, it becomes possible to form a strong electric field in the ejection portion of the ejection head 16 before image recording is performed onto the recording medium P.

As a result, even in this embodiment, it becomes possible to provide each effect of the present invention described above, that is, it becomes possible to enhance drawing stability and form a high-quality image on a recording medium with stability. Also, even in this embodiment, there is no necessity to perform control of the ejection portion, so it becomes possible to achieve an apparatus cost reduction.

Figure 14:
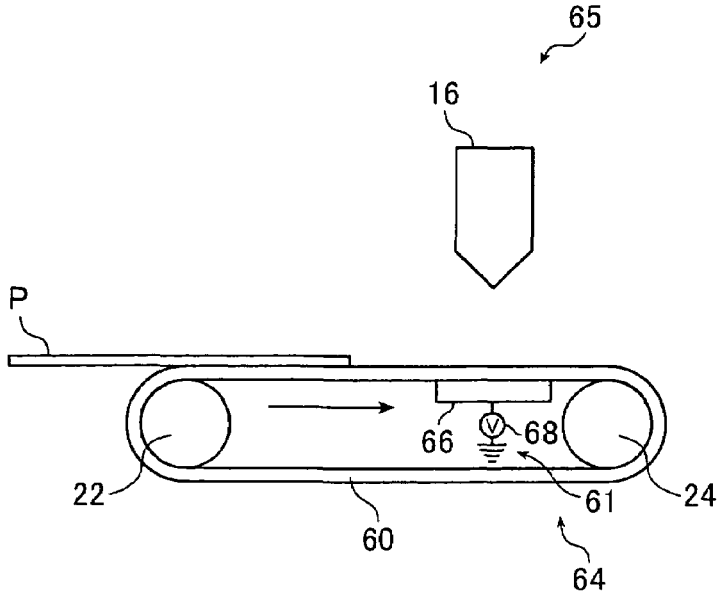
FIG. 14 is a schematic front view showing an outlined construction of still another embodiment of an ink jet recording apparatus according to the present invention.

FIG. 14 is an outlined construction diagram showing another case of the ink jet recording apparatus of the second embodiment of the present invention.

An ink jet recording apparatus 65 (hereinafter referred to as the "recording apparatus 65") shown in FIG. 14 has the same construction as the recording apparatus 15 shown in FIG. 10 except for conveyor means 64 and strong electric field generation means 61. Accordingly, each same construction element is given the same reference numeral and the detailed description thereof will be omitted. Therefore, the following description will be centered on each point unique to the recording apparatus 65.

The conveyor means 64 of the recording apparatus 65 includes the conveyor belt 60 and the belt rollers 22, 24.

In the recording apparatus 65, the conveyor belt 20 having the two-layer structure including the insulating layer 30 and the conductive layer 32 is used, however, the conveyor belt 60 in this embodiment includes only an insulation member.

Like the conveyor belt 20, the conveyor belt 60 is a ring-shaped endless belt and is stretched around the belt rollers 22, 24. Here, the belt roller 22 in this embodiment is not grounded.

It is possible to produce the conveyor belt 60 using a material that is the same as that of the insulating layer 30 of the conveyor belt 20 described above such as a polyimide resin or a fluoro resin. Herein, examples of the fluoro resin include polytetrafluoroethylene (PTFE), tetrafluoroethylene-perfluoroalkoxyethylene copolymer (PFA), tetrafluoroethylene-hexafluoropropylene copolymer (FEP), tetrafluoroethylene-ethylene copolymer (ETFE), polychlorotrifluoroethylene (PCTFE), chlorotrifluoroethylene-ethylene copolymer (ECTFE), polyvinylidene fluoride (PVDF), and polyvinyl fluoride (PVF).

Here, by setting the surface roughness Ra of the conveyor belt 60 at 5 μm or less or preferably at 2 μm or less, it becomes possible to uniformly attract and convey the recording medium P. Also, it becomes possible to obtain sufficient durability and belt conveying suitability by setting the thickness of the conveyor belt 60 at 10 to 500 μm or preferably at 50 to 300 μm. Further, it becomes possible to obtain high conveying accuracy and high durability by setting the tensile strength of the conveyor belt 60 at 100 $kg/cm^2$ or more or preferably at 120 $kg/cm^2$ or more. Still further, it becomes possible to secure favorable charge (charging potential) retentivity by setting the volume resistivity of the conveyor belt 60 at $10^{14}$ Ω·cm or more or preferably at $10^{15}$ Ω·cm or more. Yet further, it becomes possible to stabilize the conveying accuracy with respect to humidity variations by setting the water absorption (measured in accordance with ASTMD 570) of the conveyor belt at 5% or less or preferably at 2% or less.

The strong electric field generation means 61 includes a conductive platen 66 and a voltage control portion 68.

The conductive platen 66 is arranged inside the conveyor belt 60, that is, on the belt rollers 22, 24 side of the conveyor belt 60 at a position opposing the ejection head 16 so that it contacts the conveyor belt 60.

The voltage control portion 68 is connected to the conductive platen 66 and applies a voltage to the conductive platen 66. The voltage control portion 68 controls the voltage applied to the conductive platen 66 and forms a strong electric field in each ejection portion of the ejection head 16.

Figure 15A:
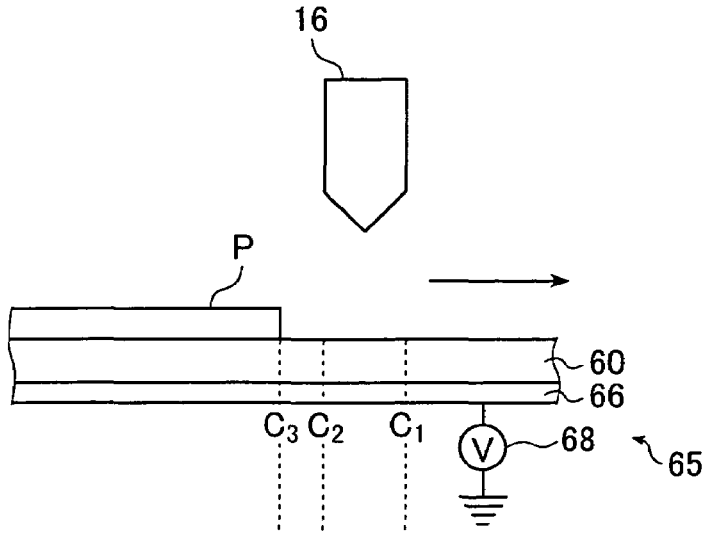
FIG. 15A is an enlarged view of the periphery of an ejection head of the ink jet recording apparatus shown in FIG. 14.
Figure 15B:
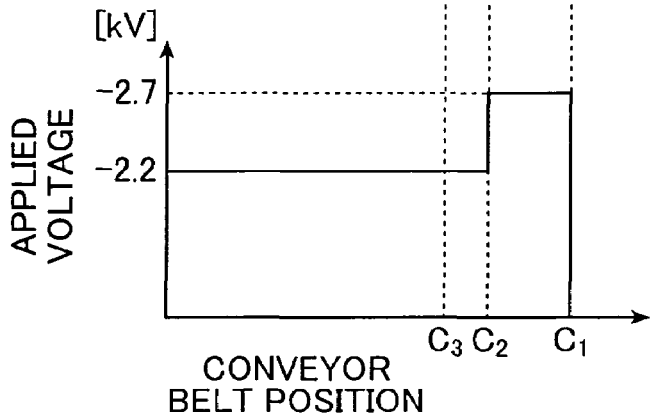
FIG. 15B is a graph showing a relation between a position of the ejection head on a conveyor belt shown in FIG. 15A and a voltage applied to a conductive platen by a voltage control portion.

Hereinafter, control of the voltage applied to the conductive platen 66 by the voltage control portion 68 will be described in detail with reference to FIGS. 15A and 15B. Here, FIG. 15A is an enlarged view of the periphery of the ejection head 16, and FIG. 15B is a graph showing a relation between the position on the conveyor belt 60 conveyed to a position opposing the ejection head 16 and the voltage applied to the conductive platen 66 by the voltage control portion 68.

First, the conveyor belt 60 to which the recording medium P is attached starts movement together with the recording medium P.

When a predetermined position ($C_1$ in FIG. 15A) of the conveyor belt 60 on the downstream side in the conveying direction with respect to a tip end portion ($C_3$ in FIG. 15A) of the recording medium P on the conveyor belt 60 in the conveying direction has reached a position opposing the ejection head 16, the voltage control portion 68 applies a high voltage (−2.7 kv, in this embodiment) to the conductive platen 66.

Following this, until a predetermined position ($C_2$ in FIG. 15A) on the conveyor belt 60 between the tip end portion ($C_3$ in FIG. 15A) of the recording medium P and the start position ($C_1$ in FIG. 15A) of the voltage application has reached the position opposing the ejection head 16, the application of the high voltage (−2.7 kV) to the conductive platen 66 is continued.

After the predetermined position ($C_2$ in FIG. 15A) between the tip end portion ($C_3$ in FIG. 15A) of the recording medium P and the start position ($C_1$ in FIG. 15A) of the voltage application has passed through the position opposing the ejection head 16, a predetermined voltage (−2.2 kV) is applied from the voltage control portion 68 to the conductive platen 66.

Following this, even while the recording medium P is passing through the position opposing the ejection head 16, that is, even after the tip end portion ($C_3$ in FIG. 15A) of the recording medium P has passed through the position opposing the ejection head 16, the application of the predetermined voltage (−2.2 kV) to the conductive platen 66 is continued. As a result, in this embodiment, at the time of image recording onto the recording medium P, the conductive platen 66 functions as a counter electrode, ink droplets are ejected by means of electric fields formed between the conductive platen 66 and the ejection electrodes of the ejection head 16, and an image is recorded onto the recording medium P.

By applying the high voltage from the voltage control portion 68 to the conductive platen 66 while the predetermined portion of the conveyor belt 60 on the downstream side in the conveying direction with respect to the attached position of the recording medium P to the conveyor belt 60 is passing through the position opposing the ejection head 16 as in this embodiment, it becomes possible to form a strong electric field in the ejection portion of the ejection head 16 before the image recording is performed onto the recording medium P.

As a result, even in this embodiment, it becomes possible to provide each effect of the present invention described above, and it becomes possible to enhance drawing stability and form a high-quality image on a recording medium with stability. Also, even in this embodiment, there is no necessity to perform control of the ejection portion, so it becomes possible to achieve an apparatus cost reduction.

Also, in this embodiment, a bias voltage is applied by applying the predetermined voltage to the conductive platen at the time of recording, however, the present invention is not limited to this. Charge means may be provided to charge the recording medium to a predetermined potential, and the bias voltage at the time of recording may be applied by means of the voltage applied to the conductive platen and the voltage to which the recording medium P has been charged.

Further, the strong electric field formation means in the respective embodiments described above may be combined with each other. For instance, the predetermined region of the conveyor belt on the downstream side in the conveying direction with respect to the attached position of the recording medium may be charged to a high potential by the charge means, and a predetermined voltage may be further applied to the conductive platen at the time when the portion charged to the high potential passes through the position opposing the ejection head.

Here, in each embodiment described above, an electric field, which is stronger than that formed in the ejection portion in a non-ink droplet ejection period during image recording onto the recording medium, is formed as the strong electric field formed in the ejection portion, however, the present invention is not limited to this. It is sufficient that a strong electric filed is formed in the ejection portion before the recording medium has reached the position opposing the ejection head, so that the ink in the ejection portion fluidly moves, whereby it is possible to prevent ink clogging ascribable to adhesion of the ink to the ejection port from occurring.

Next, a specific example of the ink jet recording apparatus in the second embodiment of the present invention will be described with reference to FIGS. 16A and 16B.

Figure 16A:
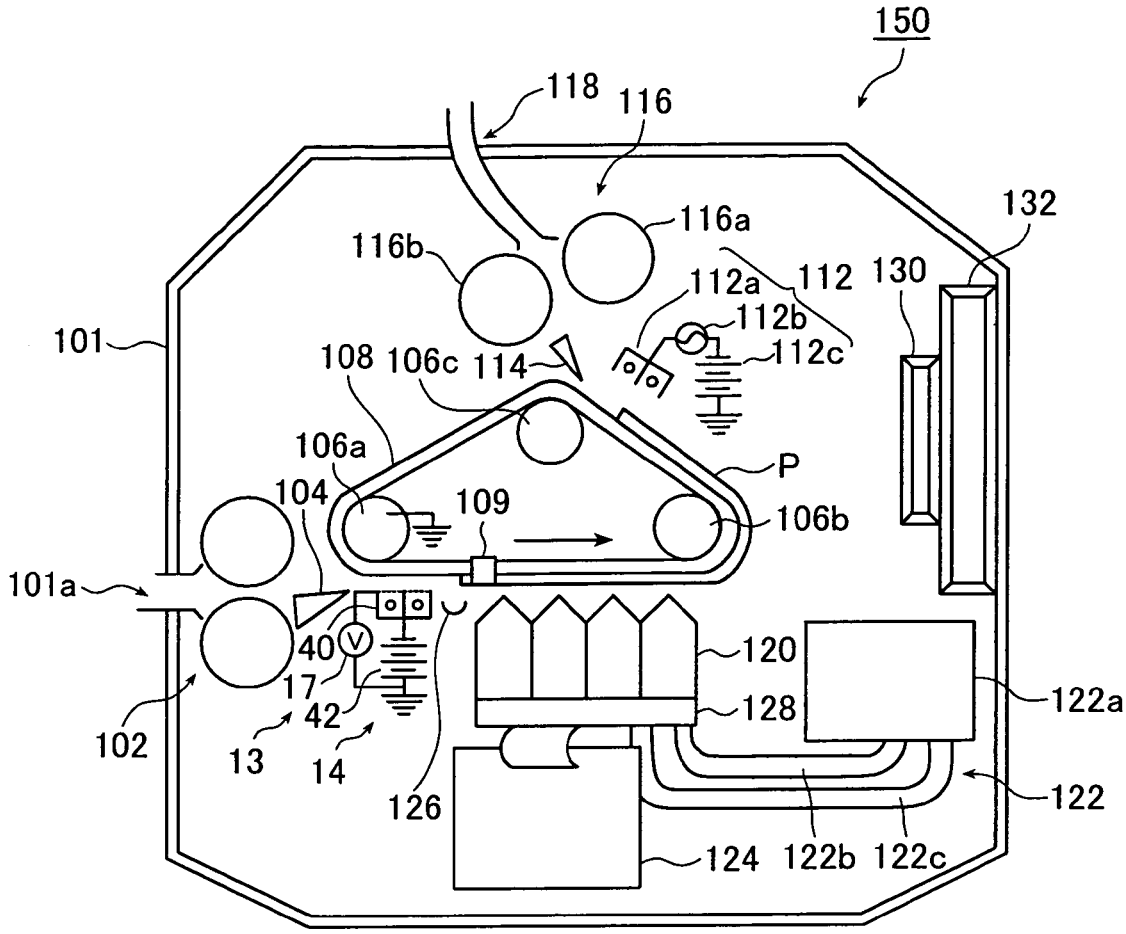
FIG. 16A is a front view conceptually showing another specific example of the ink jet recording apparatus according to the present invention.
Figure 16B:
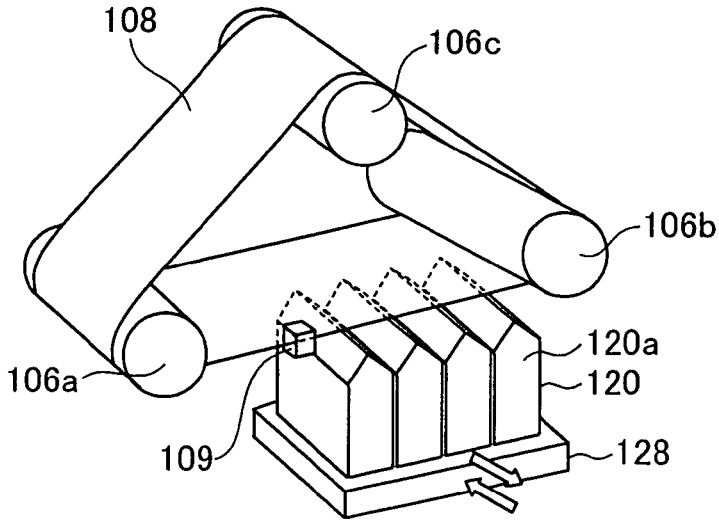
FIG. 16B is a perspective view partially showing a periphery of a head unit of the ink jet recording apparatus shown in FIG. 16A.

FIG. 16A is a schematic view showing an outlined overall construction of the specific example of the electrostatic ink jet recording apparatus in the embodiment, and FIG. 16B is a perspective view showing a head unit and a conveying system in the example shown in FIG. 16A.

An ink jet recording apparatus 150 (hereinafter, referred to as an ink jet printer 150) shown in FIG. 16A is an apparatus for performing four-color one-side printing on the recording medium P. The ink jet printer 150 includes conveying means for the recording medium P, image forming means, and solvent collecting means, all of which are accommodated in the casing 101. The conveying means includes the feed roller pair 102, the guide 104, the rollers 106*a*, 106*b* and 106*c*, the conveyor belt 108, the conveyor belt position detecting means 109, the strong electric field generation means 13, the static elimination means 112, the separation means 114, the fixation/conveyance means 116, and the guide 118. The image forming means includes the head unit 120, the ink circulating system 122, the head driver 124, the recording medium position detecting means 126 and the recording position controlling means 128. The solvent collecting means includes the discharge fan 130 and the solvent collecting device 132.

Here, the ink jet printer 150 shown in FIGS. 16A and 16B differs from the ink jet printer 100 shown in FIGS. 9A and 9B only in that the strong electric field generation means 13 is provided instead of the charge means 110 and the strong electric field formation portion 18. That is, the ink jet printer 150 is the same as the ink jet printer 100 in other points. Consequently, each same construction element is given the same reference numeral and the detailed description thereof will be omitted. Therefore, the strong electric field generation means 13 and a region on the conveyor belt that gives a strong electric field to the ejection portion with the strong electric field generation means 13 will be described below.

The strong electric field generation means 13 includes the charge means 14 and the voltage control portion 17.

The charge means 14 charges the recording medium P to a predetermined bias voltage with respect to the head unit 120 (ejection head 120*a*), charges the recording medium P to have a predetermined potential so that the recording medium P is electrostatically attracted to and held on the conveyor belt 108 under electrostatic force, and further charges a predetermined region of the conveyor belt 108, which is on the downstream side with respect to an attached position of the recording medium P to the conveyor belt 108 in the conveying direction, to a predetermined potential.

In this embodiment, the charge means 14 includes the scorotron charger 40 for charging the recording medium P and the negative high voltage power source 42 connected to the scorotron charger 40. The recording medium P is charged to a negative high voltage by the scorotron charger 40 connected to the negative high voltage power source 42, and electrostatically attracted to the insulating layer of the conveyor belt 108. As described above, the charge means 14 charges the predetermined region of the conveyor belt 108, which is on the downstream side in the conveying direction with respect to the attached position of the recording medium P, to have a potential higher than that of the recording medium P.

As described above, the charge means is not limited to the scorotron charger 40, but a corotron charger, a solid-state charger, an electrostatic discharge needle and various means and methods can be employed. As the example described above, at least one of the rollers 106*a*, 106*b* and 106*c* is composed of a conductive roller, or a conductive platen is disposed on the rear side of the conveyor belt 108 in a recording position for the recording medium P (side opposite to the recording medium P). Then, the conductive roller or the conductive platen is connected to the negative high voltage power source, thereby forming the charge means 14. Alternatively, it is also possible that the conveyor belt 108 is composed of an insulating belt and the conductive roller is grounded to connect the conductive platen to the negative high voltage power source.

The charge means 14 charges a predetermined region (strongly charged portion) of the conveyor belt 108 which is on the downstream side in the conveying direction with respect to the attached position of the recording medium P to a potential higher than that of the recording medium P, and further makes the recording medium P electrostatically attracted to the conveyor belt 108 by electrostatic force in a state where the recording medium P is placed on the conveyor belt 108 without the presence of any air therebetween. Thereafter, the charge means 14 uniformly charges the surface of the recording medium P while the conveyor belt 108 is being driven. Note that the conveying speed of the conveyor belt 108 when charging the recording medium P may be in a range where the charging is performed with stability, so the speed may be the same as, or different from, the conveying speed at the time of image recording. Also, the charge means may act on the same recording medium P several times by circulating the recording medium P several times on the conveyor belt 108 for uniform charging.

The recording medium P and the strongly charged portion of the conveyor belt 108 charged by the charge means 14 are conveyed to the position opposing the head unit 120 to be described later by the conveyor belt 108. As described above, the strongly charged portion has been formed in a region of the conveyor belt 108 on the downstream side in the conveying direction with respect to the attached position of the recording medium P. As a result, the strongly charged portion passes through the position opposing the head unit 120 and places every ejection portion of the head unit 120 under the ink-wet state before the recording medium P is conveyed to the position opposing the head unit 120.

Next, the region on the conveyor belt (hereinafter referred to as the "strong electric field formation region 140") that gives a strong electric field to the ejection portion with the strong electric field generation means 13 at the time when the ejection head 120*a* exists at an opposing position will be described with reference to FIGS. 17A to 17C. Here, in this specific embodiment, the strong electric field formation region 140 is a strongly charged portion that is charged to a high potential by the scorotron charger (40).

Figure 17A:
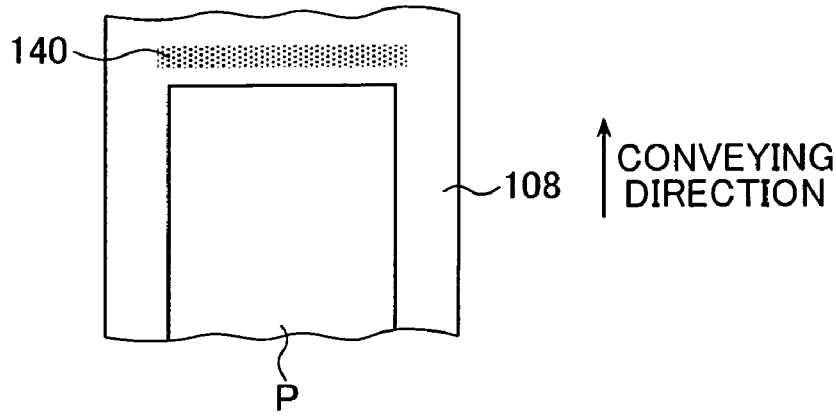
FIGS. 17A to 17C are each a partial enlarged view schematically showing an example of a strong electric field formation region on a conveyor belt of the ink jet recording apparatus shown in FIG. 10.
Figure 17B:
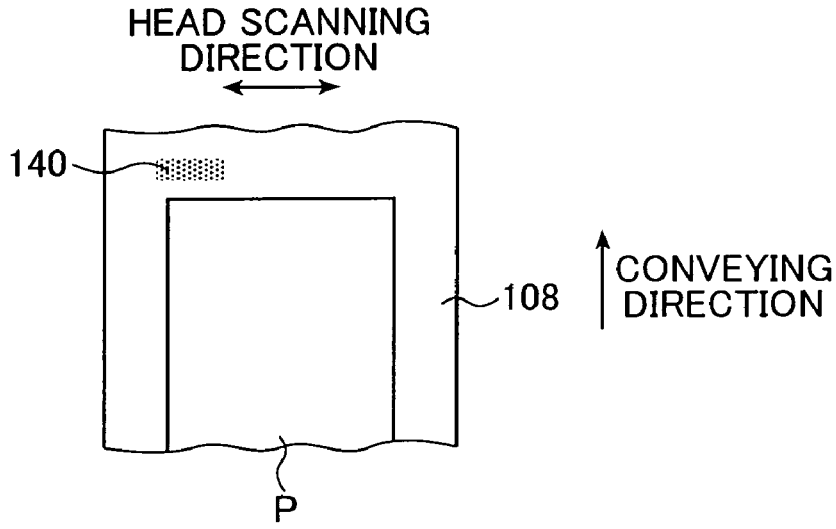
Figure 17C:
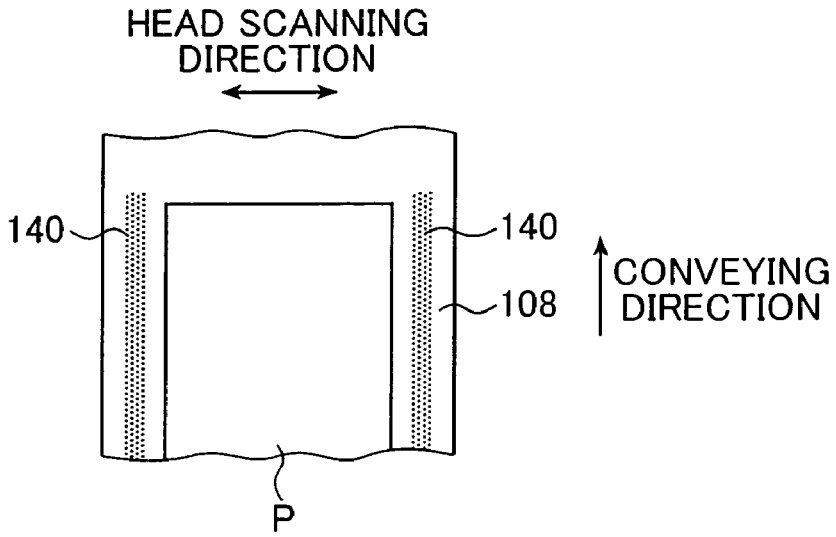
Figure 18:
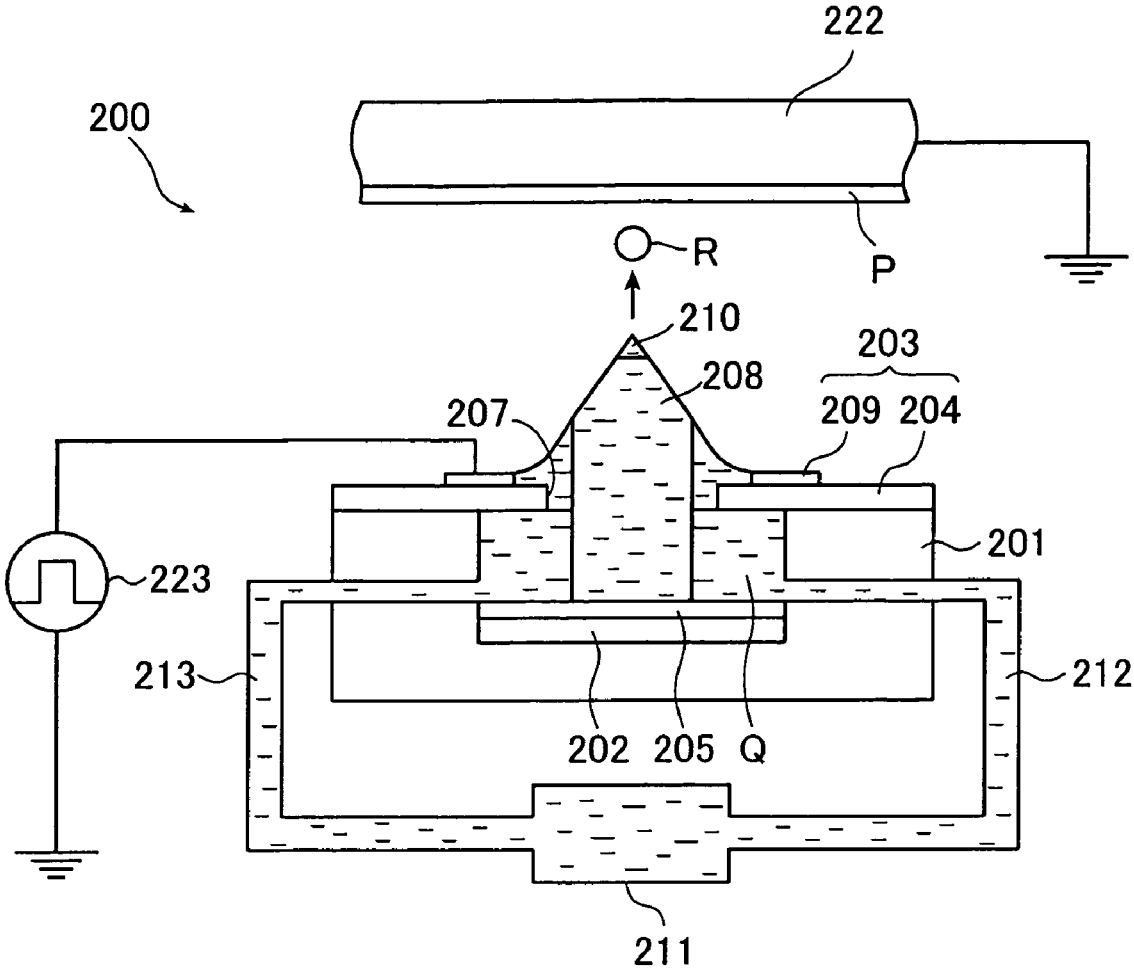
FIG. 18 PRIOR ART
FIG. 18 is a conceptual diagram showing an ink jet head of a conventional ink jet recording apparatus.

FIGS. 17A to 17C are each a partial enlarged view schematically showing the strong electric field formation region 140 on the conveyor belt 108. In FIGS. 17A to 17C, the recording medium P is conveyed in an upward direction in the figures. Also, FIGS. 17B and 17C show a case where the head unit 120 (ejection head 120*a*) is a serial head and the head unit 120 is scanned in a horizontal direction in the figures.

In the case of a line head as in this embodiment, as shown in FIG. 17A, the strong electric field formation region 140 is provided on the downstream side of the recording medium P in the conveying direction with a length that is approximately the same as that of the conveyor belt 108 in a width direction, that is, a direction orthogonal to the conveying direction, as described above.

Also, when the head unit is a serial head as described above, the present invention is not limited to the example described above, and it becomes possible to provide the effects of the present invention by providing the strong electric field formation region 140 having a width that is at least equal to or more than that of the head unit 120 on the conveyor belt 108 as shown in FIG. 17B.)

Further, in the case of the serial head, as shown in FIG. 17C, the strong electric field formation region 140 may be provided at both end portions of the conveyor belt 108 in the direction orthogonal to the conveying direction of the recording medium P to extend in the conveying direction of the recording medium P.

When the strong electric field formation region 140 is provided on a part of the conveyor belt 108 in the width direction as shown in FIGS. 17B and 17C, a grid of the scorotron charger (40) may be divided correspondingly.

In the case of providing the strong electric field formation region 140 in the manner described above, when an image is recorded onto the recording medium P by scanning the ejection head 120*a* in the direction orthogonal to the conveying direction of the recording medium P, the ejection head 120*a* is moved to a position opposing the strong electric field formation portion 140. Whereby, it becomes possible to form a strong electric field in the ejection portion of the ejection head 120*a* immediately before the recording medium P and the ejection head 120*a* are relatively moved to the image recordable position at the time of image recording onto the recording medium P, which makes it possible to set the ejection characteristics of the ejection portion constant. As a result, it becomes possible to further improve drawing stability.

Here, in the second embodiment of the present invention, it is sufficient that a strong electric field is formed in every ejection portion of the head-unit 120 at least before recording is performed onto the recording medium P. That is, the number of times, frequency, and the like of the movement of the head unit 120 to the position opposing the strong electric field formation region 140 to generate the strong electric field in the ejection portion of the head unit 120 are not specifically limited. Therefore, the head unit 120 may be moved to the position opposing the strong electric field formation region 140 each time a scanning operation of the head unit 120 is performed or may be moved to the position opposing the strong electric field formation region 140 each time a predetermined number of scanning operations of the head unit 120 is performed.

Also, it is possible to set the length of the strong electric field formation region 140 in the longitudinal direction at an arbitrary length such as a length, which is approximately the same as that of the recording medium P in the conveying direction, or the whole circumferential length of the conveyor belt 108.

Further, in the example shown in FIG. 17C, the strong electric field formation region 140 is provided at both end portions of the conveyor belt 108 in the direction orthogonal to the conveying direction. However, the strong electric field formation region 140 may be provided only at one of the end portions of the conveyor belt 108 in the direction orthogonal to the conveying direction.

In each of the above described embodiments, the ink jet recording apparatus has been described, in which ink jet image recording is performed by positively charging the colorant particles in the ink and charging the recording medium P or the counter electrode (conductive platen) on the back of the recording medium to the negative high voltage. However, the present invention is not limited to this. That is, contrary to the above, the ink jet image recording may be performed by negatively charging the colorant particles in the ink and charging the recording medium or the counter electrode to the positive high voltage. When the charged color particles have the polarity opposite to that in the above-mentioned embodiments, it is sufficient that the applied voltage to the charge means, the counter electrode and the ejection electrode of the electrostatic ink jet head is changed to have the polarity opposite to that in the above-mentioned embodiments.

Also, the present invention is not specifically limited to the electrostatic ink jet recording apparatus that ejects ink containing charged colorant components, and is applicable to any other liquid ejection heads that eject liquids containing colorant particles. For instance, aside from the electrostatic ink jet recording apparatus described above, it is possible to apply the present invention to an application apparatus that ejects droplets utilizing charged particles to apply it to a target.

The electrostatic ink jet recording apparatus and recording method according to the present invention have been described in detail above based on various embodiments, however, the present invention is not limited to the above embodiments and it is of course possible to make various modifications and changes without departing from the gist of the present invention.

According to the first embodiment of the first and second aspects in the present invention, a strong electric field is formed in each ejection portion with the strong electric field formation portion immediately before the recording medium and the ink jet head are relatively moved to the image recordable position, so it becomes possible to set the state of each ejection portion immediately before start of image recording onto the recording medium stable regardless of an ejection history and set ejection characteristics constant. As a result, it becomes possible to enhance drawing stability and form a high-quality image with stability.

Also, it becomes possible to set the ejection characteristics constant without performing control of an ejection signal, so it becomes possible to control ink droplet ejection with stability using a simple driver, which makes it possible to provide an inexpensive ink jet recording apparatus.

According to the second embodiment of the first and second aspects in the present invention, an electric field that is stronger than that formed in each ejection portion in a non-ink droplet ejection period during image recording onto the recording medium is given to the ejection portion immediately before the recording medium and the ink jet head are relatively moved to the image recordable position, so it becomes possible to set the state of each ejection portion immediately before start of the image recording onto the recording medium stable regardless of an ejection history and set ejection characteristics constant. As a result, it becomes possible to enhance drawing stability and form a high-quality image with stability.

Also, it becomes possible to set the ejection characteristics constant without performing control of an ejection signal, so it becomes possible to control ink droplet ejection with stability using a simple driver, which makes it possible to provide an inexpensive ink jet recording apparatus.

What is claimed is:

1. An ink jet recording apparatus comprising:

conveyor means including an insulative placing portion on which a recording medium onto which an image is recorded is placed, said conveyor means conveying said recording medium placed on said insulative placing portion;

an ink jet head disposed at a position opposing said conveyor means and including at least one ejection portion that ejects ink droplets toward said recording medium by exerting electrostatic force on ink in accordance with an image signal; and strong electric field generation means for forming a strong electric field in said ejection portion immediately before said recording medium and said ink jet head that are relatively moved to an image recordable position, wherein said strong electric field generation means includes charge means and a strong electric field formation portion that is charged by said charge means to give to said ejection portion an electric field strength that is stronger than those of said recording medium and said insulative placing portion.

2. The ink jet recording apparatus according to claim 1, wherein said strong electric field formation portion is a member whose insulation property is higher than insulation properties of said recording medium and said insulative placing portion.

3. The ink jet recording apparatus according to claim 1, wherein said strong electric field formation portion includes a member which is provided to at least a part of said conveyor means and whose insulation property is higher than insulation properties of said recording medium and said insulative placing portion.

4. The ink jet recording apparatus according to claim 1, wherein said strong electric field formation portion is a projection portion that is provided to at least a part of said conveyor means and protrudes toward an ink jet head side with respect to said recording medium and said insulative placing portion.

5. The ink jet recording apparatus according to claim 1, wherein said charge means charges at least one of said recording medium and said insulative placing portion, and charges said strong electric field formation portion so that said electric field strength that is stronger than those of said recording medium and said insulative placing portion is given to said ejection portion.

6. The ink jet recording apparatus according to claim 1, wherein said conveyor means includes: an insulating layer, which serves as said insulative placing portion on which said recording medium is placed; and a conveyor belt that conveys said recording medium placed on said insulating layer.

7. The ink jet recording apparatus according to claim 1, wherein said ink jet head includes at least one ejection port through which said ink droplets are ejected, and at least one ink guide which passes through said at least one ejection port and whose tip end portion protrudes toward a recording medium side from an opening surface of said at least one ejection port.

8. The ink jet recording apparatus according to claim 7, wherein said ink jet head includes: an ejection port substrate in which said at least one ejection port is formed; a head substrate which is arranged to be spaced apart from said ejection port substrate by a predetermined distance and forms an ink flow path in a space between said head substrate and said ejection port substrate, said head substrate having said at least one ink guide formed on an ejection port substrate side surface at positions opposing said at least one ejection port; and at least one ejection electrode that is arranged around said at least one ejection port of said ejection port substrate, for controlling said ejection of said ink droplets from said at least one ejection port.

9. An ink jet recording apparatus comprising:

conveyor means including an insulative placing portion on which a recording medium onto which an image is recorded is placed, said conveyor means conveying said recording medium placed on said insulative placing portion;

an ink jet head disposed at a position opposing said conveyor means and including at least one ejection portion that ejects ink droplets toward said recording medium by exerting electrostatic force on ink in accordance with an image signal; and strong electric field generation means for giving to said ejection portion an electric field strength that is stronger than an electric field strength formed in said ejection portion in a non-ink droplet ejection period during said recording of said image on said recording medium, immediately before said recording medium and said ink jet head that are relatively moved to an image recordable position.

10. The ink jet recording apparatus according to claim 9, wherein said strong electric field generation means gives the stronger electric field strength to said ejection portion, immediately before said recording medium is conveyed by said conveyor means to said image recordable position at which image recording by said ink jet head is possible.

11. The ink jet recording apparatus according to claim 9, wherein said ink jet head can be scanned in at least one direction with respect to said recording medium, and wherein said strong electric field generation means gives the stronger electric field strength to said ejection portion, immediately before said ink jet head is scanned to said image recordable position at which image recording with respect to said recording medium is possible.

12. The ink jet recording apparatus according to claim 9, wherein said conveyor means includes a conveyor belt to which said recording medium is attached, wherein said strong electric field generation means includes charge means for charging at least one of said recording medium and said conveyor belt to cause electrostatic attraction of said recording medium by said conveyor belt, and a charge means control portion that controls said charge means, and wherein said charge means control portion performs control through which at least a part of said conveyor belt on a downstream side in a conveying direction with respect to an attached position of said recording medium is charged to a potential that is higher than a potential of said recording medium.

13. The ink jet recording apparatus according to claim 9, wherein said conveyor means includes a conveyor belt having: an insulating layer forming a contact surface with said recording medium; and a conductive layer provided on a surface of said insulating layer on a side opposite to said contact surface with said recording medium.

14. The ink jet recording apparatus according to claim 13, wherein said strong electric field generation means includes a voltage control portion that controls a voltage applied to said conductive layer, and wherein said voltage control portion applies a predetermined voltage to said conductive layer immediately before said recording medium and said ink jet head that are being relatively moved reach said image recordable position.

15. The ink jet recording apparatus according to claim 9, wherein said conveyor means includes a conveyor belt formed by an insulative member, wherein said strong electric field generation means includes a conductive plate-shaped member arranged in contact with said conveyor belt and provided to a surface of said conveyor belt on a side opposite to an ink jet head side at a position opposing said ink jet head, and a voltage control portion that controls a voltage applied to said conductive plate-shaped member, and wherein said voltage control portion applies a predetermined voltage to said conductive plate-shaped member immediately before said recording medium and said ink jet head that are being relatively moved reach said image recordable position.

16. The ink jet recording apparatus according to claim 9, wherein said ink jet head includes at least one ejection port through which said ink droplets are ejected, and at least one ink guide which passes through said at least one ejection port and whose tip end portion protrudes toward a recording medium side from an opening surface of said at least one ejection port.

17. The ink jet recording apparatus according to claim 16, wherein said ink jet head includes: an ejection port substrate in which said at least one ejection port is formed; a head substrate which is arranged to be spaced apart from said ejection port substrate by a predetermined distance and forms an ink flow path in a space between said head substrate and said ejection port substrate, said head substrate having said at least one ink guide formed on an ejection port substrate side surface at positions opposing said at least one ejection port; and at least one ejection electrode that is arranged around said at least one ejection port of said ejection port substrate, for controlling said ejection of said ink droplets from said at least one ejection port.

18. An ink jet recording method comprising:

conveying a recording medium to a position opposing an ink jet head by conveyor means;

recording an image onto said recording medium conveyed to said position with said ink jet head by ejecting ink droplets from at least one ejection portion toward said recording medium through exertion of electrostatic force on ink in accordance with an image signal; and passing through said position opposing said ink jet head a strong electric field formation portion which gives to said ejection portion an electric field strength that is stronger than an electric field strength of said recording medium, immediately before said recording medium and said ink jet head are relatively moved to said image recordable position.

19. An ink jet recording method comprising:

conveying a recording medium to a position opposing an ink jet head by conveyor means;

recording an image onto said recording medium conveyed to said position with said ink jet head by ejecting ink droplets from at least one ejection portion toward said recording medium through exertion of electrostatic force on ink in accordance with an image signal; and giving to said ejection portion an electric field strength that is stronger than an electric field strength formed in said ejection portion in a non-ink droplet ejection period during said recording of said image on said recording medium, immediately before said recording medium and said ink jet head that are relatively moved to an image recordable position.

20. The ink jet recording method according to claim 19, wherein said stronger electric field strength is momentarily given to said ejection portion before said recording medium is conveyed to said position opposing said ink jet head.

21. The ink jet recording method according to claim 19, wherein said stronger electric field strength is given to said ejection portion by charging a part of said conveyor means on a downstream side in a conveying direction with respect to an attached position of said recording medium to a potential that is higher than a potential of said recording medium.

22. The ink jet recording method according to claim 19, wherein said stronger electric field strength is given to said ejection portion by applying a predetermined voltage to said conveyor means.

23. The ink jet recording method according to claim 19, wherein said ink jet head includes at least one ejection port through which said ink droplets are ejected, and at least one ink guide which passes through said at least one ejection port and whose tip end portion protrudes toward a recording medium side from an opening surface of said at least one ejection port.

* * * * *